US008892021B2

(12) United States Patent
Hasegawa et al.

(10) Patent No.: US 8,892,021 B2
(45) Date of Patent: Nov. 18, 2014

(54) IMAGE FORMING APPARATUS, PROTECTIVE AGENT SUPPLYING MEMBER AND PROTECTIVE LAYER FORMING APPARATUS

(71) Applicants: Kunio Hasegawa, Kanagawa (JP); Hiroshi Nakai, Kanagawa (JP); Takuya Sekine, Kanagawa (JP)

(72) Inventors: Kunio Hasegawa, Kanagawa (JP); Hiroshi Nakai, Kanagawa (JP); Takuya Sekine, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 30 days.

(21) Appl. No.: 13/769,891

(22) Filed: Feb. 19, 2013

(65) Prior Publication Data

US 2013/0216286 A1 Aug. 22, 2013

(30) Foreign Application Priority Data

Feb. 21, 2012 (JP) ..... 2012-035239

(51) Int. Cl.
*G03G 21/00* (2006.01)

(52) U.S. Cl.
CPC ..... *G03G 21/00* (2013.01); *G03G 21/0058* (2013.01); *G03G 21/0094* (2013.01)
USPC ..... 399/346; 399/357

(58) Field of Classification Search
CPC ..... G03G 21/00; G03G 21/0094
USPC ..... 399/346, 357
See application file for complete search history.

(56) References Cited

U.S. PATENT DOCUMENTS

| | | | | |
|---|---|---|---|---|
| 3,501,294 | A | 3/1970 | Joseph | |
| 6,160,977 | A * | 12/2000 | Takeichi et al. | 399/127 |
| 2006/0285897 | A1 | 12/2006 | Sugiura et al. | |
| 2007/0068738 | A1 | 3/2007 | Kawahara et al. | |
| 2009/0196665 | A1 | 8/2009 | Tanaka et al. | |
| 2009/0285613 | A1 | 11/2009 | Nakai et al. | |
| 2009/0290919 | A1 | 11/2009 | Tanaka et al. | |
| 2009/0304423 | A1 | 12/2009 | Ozaki et al. | |
| 2009/0311014 | A1 | 12/2009 | Tanaka et al. | |
| 2010/0034560 | A1 | 2/2010 | Tanaka et al. | |
| 2010/0054829 | A1 | 3/2010 | Iio et al. | |
| 2010/0183972 | A1 | 7/2010 | Hasegawa et al. | |
| 2010/0209143 | A1 | 8/2010 | Nakai et al. | |
| 2010/0239309 | A1 | 9/2010 | Tanaka et al. | |
| 2010/0310291 | A1 | 12/2010 | Tanaka et al. | |

(Continued)

FOREIGN PATENT DOCUMENTS

| | | |
|---|---|---|
| JP | 51-022380 | 7/1976 |
| JP | 2006-350240 | 12/2006 |

(Continued)

*Primary Examiner* — Benjamin Schmitt
(74) *Attorney, Agent, or Firm* — Harness, Dickey & Pierce, P.L.C.

(57) ABSTRACT

An image forming apparatus includes at least: an image bearing member; a protective layer forming unit including at least a protective agent supplying member and an image bearing member protective agent; and a rotational speed controlling unit. In at least one embodiment, the protective agent supplying member includes a core material and a foam layer including a plurality of cells, and a number of cells n existing at a contact portion between a surface of the image bearing member and the protective agent supplying member is greater than 9 and less than 23. Further, a traveling speed V of the cells with respect to the surface of the image bearing member at the contact portion is greater than 837 cells/mm2/s and less than 4,670 cells/mm2/s.

6 Claims, 8 Drawing Sheets

(56) References Cited

U.S. PATENT DOCUMENTS

| | | | | |
|---|---|---|---|---|
| 2011/0008088 | A1 | 1/2011 | Nakai et al. | |
| 2011/0038656 | A1 | 2/2011 | Hasegawa et al. | |
| 2011/0052286 | A1 | 3/2011 | Urayama et al. | |
| 2011/0206431 | A1 * | 8/2011 | Tawada et al. | 399/346 |
| 2012/0057912 | A1 | 3/2012 | Hasegawa et al. | |
| 2012/0060753 | A1 | 3/2012 | Tanaka et al. | |
| 2012/0063809 | A1 | 3/2012 | Tanaka et al. | |
| 2012/0063825 | A1 | 3/2012 | Hasegawa et al. | |
| 2012/0141177 | A1 | 6/2012 | Urayama et al. | |
| 2012/0195662 | A1 | 8/2012 | Hasegawa et al. | |
| 2013/0259552 | A1 * | 10/2013 | Hasegawa et al. | 399/346 |

FOREIGN PATENT DOCUMENTS

| | | |
|---|---|---|
| JP | 2007-065100 | 3/2007 |
| JP | 2007-293240 | 11/2007 |
| JP | 2009-150986 | 7/2009 |
| JP | 2012-058539 | 3/2012 |

* cited by examiner

IMAGE FORMING APPARATUS, PROTECTIVE AGENT SUPPLYING MEMBER AND PROTECTIVE LAYER FORMING APPARATUS

BACKGROUND OF THE INVENTION

1. Field of the Invention

The present invention relates to an image forming apparatus, a protective agent supplying member and a protective layer forming apparatus.

2. Description of the Related Art

In general, regardless of differences in a developing system, an image forming apparatus by a conventional electrophotographic method forms an image by: charging uniformly a drum-shaped or a belt-shaped image bearing member (which may also be referred to as an "electrostatic latent image bearing member", an "electrophotographic photoconductor" or a "photoconductor") while rotating it; forming a latent-image pattern on the image bearing member with a laser light; forming a visible image from it by a developing apparatus; and further transferring a toner image on a transfer medium.

In general, after a transfer step, a toner component and so on remaining on the image bearing member is removed in a cleaning step to have a surface of the image bearing member in a sufficiently clean state, and then charging is carried out.

However, in recent years, colorization of an output image is in progress, and a toner having a smaller diameter and a larger sphericity is desired for high-quality image and stable image quality. When such a toner is used in an electrophotographic image forming method, it is difficult to remove the toner in the cleaning step, and challenges for cleaning are getting larger. After a toner image is transferred on the transfer medium and if a toner component not transferred remains on the image bearing member, the residual of the toner component is conveyed directly to the charging step. This is a problem that it inhibits uniform charging of the image bearing member.

There is a method to increase rubbing power of a cleaning member against the image bearing member in order to remove the toner having a smaller diameter and a larger sphericity in the cleaning step. In this case, however, there is a problem that abrasion of the image bearing member or the cleaning member significantly advances.

Also, factors of the adhesion of the toner to the image bearing member also include the charging step.

In recent years, as a charging method of an electrophotographic image forming apparatus, an AC superimposed charging system that an alternating-current (AC) component is superimposed on a direct-current (DC) component has been used. A close charging system by the AC superimposed charging system can downsize the apparatus while achieving high-quality image. At the same time, since it may have the charging member and the image bearing member in a non-contact state while maintaining uniformity of the charge, there is no minor unevenness at a contact between the charging member and a surface of the image bearing member or gap variation between the charging member and the surface of the image bearing member, and as a result, degradation of the charging member may be suppressed.

However, when the image bearing member is an organic photoconductor (OPC), energy of the AC superimposed charging cuts resin chains at the surface of the image bearing member, which reduces mechanical strength, and there is a problem that the image bearing member wears significantly. Since the superimposed charging activates the surface of the image bearing member, adhesive force between the surface of the image bearing member and a toner increases, and there is also a problem that cleanability against the image bearing member decreases.

Accordingly, there exist electrical stresses and physical stresses in the steps of image formation by the electrophotographic method, and the image bearing member which has received these stresses have a surface condition thereof changed over time due to use.

For such a problem, technologies to apply a protective agent on a surface of the image bearing member have been proposed.

For example, a method that a block-shaped protective agent having zinc stearate as a main component, a so-called protective agent block, is applied on a surface of an image bearing member (see Japanese Patent Application Publication (JP-B) No. 51-22380), a method that a protective agent block having zinc stearate as a main component with an addition of boron nitride is applied on a surface of an image bearing member (see Japanese Patent Application Laid-Open (JP-A) No. 2006-350240) and so on are proposed.

Application of the protective agent block on the surface of the image bearing member reduces a frictional coefficient of the surface of the image bearing member and reduces degradation of a cleaning blade or the image bearing member, and at the same time, it improves detachment of deposits adhering to the surface of the image bearing member such as toner components not transferred. As a result, it is possible to prevent cleaning defects and occurrence of filming over time.

Also, as a technique to apply the protective agent block on the surface of the image bearing member, a protective layer forming apparatus including: a protective agent block; a protective agent supplying member including a brush-shaped rotary member, which contacts the protective agent block to adhere it on a surface thereof and applies a protective agent on an image bearing member; and a protective agent pressurizing member, which pressurizes the protective agent block so that it contacts the protective agent supplying member is proposed (see JP-A No. 2007-65100 and JP-A No. 2007-293240).

However, there is a problem with these proposed technologies that, depending on a rotation of the brush-shaped rotary member, powder of the protective agent rubbed from the protective agent block flies in a large quantity, resulting in a large quantity of the protective agent being wasted. Also, brush fibers get flattened or degraded over time, and there is a problem that a predetermined amount of the protective agent cannot be supplied over a long period of time because of unstable consumption of the protective agent.

Therefore, a technology to use a roller-shaped protective agent supplying member having a foam layer as a protective agent supplying member of a protective layer forming apparatus is proposed (see JP-A No. 2009-150986). With this proposed technology, powder of a protective agent by rubbing hardly flies.

However, with this proposed technology, since the foam layer is composed of isolated cells, the foam layer is degraded or destructed over time due to rubbing with the protective agent block or the image bearing member. As a result, there is a problem of filming of the image bearing member due to insufficient supply of the protective agent to the image bearing member over a long period of time.

Thus, there currently is being asked strongly to provide an image forming apparatus which may stably supply a predetermined amount of a protective agent over a long period of time only by applying a low pressure (low stresses) to an image bearing member without degradation or destruction of a foam layer, which may supply a protective agent uniformly to the image bearing member even in a small amount, which may suppress wear of the image bearing member or a cleaning member, which may prevent occurrence of filming of the image bearing member, which includes a simple protective layer supplying unit having a small and simple structure, which is small, and which may stably form a high-quality image over a long period of time.

The present invention aims at solving the above problems in the conventional technologies and at achieving the following objection. That is, the present invention aims at providing an image forming apparatus which is small in size and stably forms a high-quality image over time, including a protective layer supplying unit which stably supplies a predetermined amount of a protective agent over a long period of time only by applying a low pressure (low stresses) to an image bearing member without degradation or destruction of a foam layer, supplies a protective agent uniformly to the image bearing member even in a small amount, suppresses wear of the image bearing member or a cleaning member, prevents occurrence of filming of the image bearing member, and includes a simple protective layer supplying unit having a small and simple structure.

SUMMARY OF THE INVENTION

An image forming apparatus of the present invention is an image forming apparatus including at least: an image bearing member; a protective layer forming unit which includes at least a protective agent supplying member which rotatably contacts a surface of the image bearing member and an image bearing member protective agent; and a rotational speed controlling unit which controls a rotational speed of the protective agent supplying member, wherein the image bearing member protective agent includes at least a metal salt of a fatty acid and an inorganic lubricant, wherein the protective agent supplying member includes: a core material; and a foam layer formed on an outer periphery of the core material and including a plurality of cells, wherein a number of cells n is greater than 9 and less than 23, where n is the number of cells existing at a contact portion of a surface of the image bearing member and the protective agent supplying member on a cross-sectional surface in a circumferential direction of the image bearing member and the protective agent supplying member, and wherein the rotational speed controlling unit controls a traveling speed V of the cells with respect to the surface of the image bearing member at the contact portion within a range of greater than 837 cells/mm$^2$/s and less than 4,670 cells/mm$^2$/s.

According to the present invention, the conventional problems are solved, and the objects are achieved, and it is possible to provide an image forming apparatus which may stably supply a predetermined amount of a protective agent over a long period of time only by applying a low pressure (low stresses) to an image bearing member without degradation or destruction of a foam layer, which may supply a protective agent uniformly to the image bearing member even in a small amount, which may suppress wear of the image bearing member or a cleaning member, which may prevent occurrence of filming of the image bearing member, which includes a simple protective layer supplying unit having a small and simple structure, which is small, and which may stably form a high-quality image over a long period of time.

DETAILED DESCRIPTION OF THE INVENTION

Figure 1A:
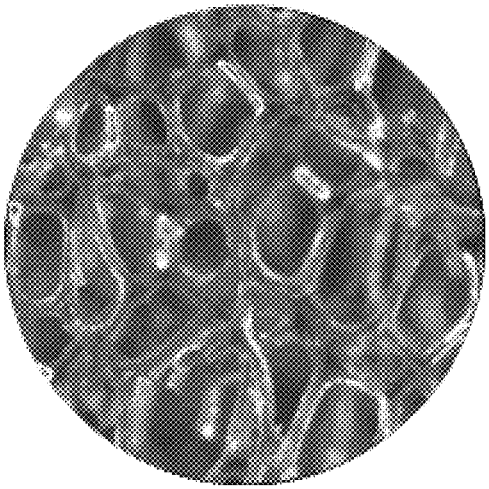
FIG. 1A is a photograph illustrating one example of a foam layer of continuous cells.

Image Forming Apparatus, Protective Agent Supplying Member

An image forming apparatus of the present invention includes at least: an image bearing member (which may hereinafter also be referred to as an "electrostatic latent image bearing member", an "electrophotographic photoconductor", a "photoconductor" and so on); a protective layer forming unit; and a rotational speed controlling unit, and it further includes other units according to necessity.

A protective agent supplying member of the present invention is a protective agent supplying member used in the image forming apparatus of the present invention, and it includes at least: a core material; and a foam layer formed on an outer periphery of the core material and including a plurality of cells, and it further includes other units according to necessity.

Hereinafter, in addition to an explanation of the image forming apparatus the present invention, the protective agent supplying member of the present invention is explained.

<Protective Layer Forming Unit>

The protective layer forming unit includes at least: a protective agent supplying member which rotatably contacts a surface of the image bearing member; and an image bearing member protective agent (hereinafter, it may simply be abbreviated as a "protective agent"), and it further includes other members according to necessity.

<<Protective Agent Supplying Member>>

The protective agent supplying member includes at least: a core material; and a foam layer formed on an outer periphery of the core material and including a plurality of cells, and it further includes other members according to necessity.

The protective agent supplying member is a member which scrapes off the protective agent and supplies the protective agent to a surface of the image bearing member.

A shape of the protective agent supplying member is not particularly restricted and may be appropriately selected according to purpose. Nonetheless, it is preferably a shape of a roller.

—Core Material—

A material, a shape, a size and a structure of the core material are not particularly restricted and may be appropriately selected according to purpose.

Examples of the material of the core material include: resins such as epoxy resin, phenolic resin and so on; and metals such as iron, aluminum, stainless steel and so on.

Examples of the shape of the core material include a column, a cylinder and so on.

—Foam Layer—

The foam layer is a layer formed on an outer periphery of the core material, and it includes a plurality of bubbles (they may also be referred to as "cells", "holes", "voids" and so on).

A shape of the foam layer is not particularly restricted and may be appropriately selected according to purpose. Examples thereof include a cylinder and so on.

A material of the foam layer is not particularly restricted and may be appropriately selected according to purpose. Examples thereof include foamed polyurethane and so on.

—Foamed Polyurethane—

The foamed polyurethane is not particularly restricted and may be appropriately selected according to purpose. Examples thereof include foamed polyurethane obtained by reaction of a mixture of at least a polyol, a polyisocyanate, a catalyst and a foaming agent with addition of other components such as foam stabilizer and so on according to necessity.

—Polyol—

The polyol is not particularly restricted, and it may be appropriately selected from heretofore known conventional polyols according to purpose. Examples thereof include polyether polyol, polyester polyol and so on. Among these, the polyether polyol is preferable since it is easy to adjust its easier adjustment of processability and hardness of the foam layer.

Examples of the polyether polyol include polyether polyol obtained by ring-opening addition polymerization of at least any one of ethylene oxide and propylene oxide to which at least any one of a low-molecular polyol and a low-molecular polyamine having 2 to 8 active hydrogen groups as an initiator.

Also, examples of the polyether polyol include a polyether-polyether polyol, a polyester-polyether polyol, a polymer-polyether polyol and so on, which are generally used for manufacturing a flexible polyurethane foam.

As the polyether polyol, a polyether-polyether polyol to which ethylene oxide is terminally bonded by 5% by mole or more is preferable in view of formability.

Examples of the polyester polyol include a polyester polyol obtained by polymerizing: a dibasic acid or an anhydride thereof such as adipic acid, phthalic anhydride, isophthalic acid, terephthalic acid, maleic anhydride and so on; and a glycol or a triol such as ethylene glycol, diethylene glycol, triethylene glycol, propylene glycol, dipropylene glycol, 1,4-butanediol, glycerin, trimethylolpropane and so on.

Also, as the polyester polyol, a polyester polyol obtained by depolymerizing a waste of a polyethylene terephthalate resin with the glycol may also be used.

The polyol may be used alone or in combination of two or more.

—Polyisocyanate—

The polyisocyanate is not particularly restricted, and it may be appropriately selected from conventional heretofore known various polyisocyanates according to purpose. Examples thereof include 2,4-tolylene diisocyanate (2,4-TDI), 2,6-tolylene diisocyanate (2,6-TDI), tolidine diisocyanate (TODD, 1,5-naphthylene diisocyanate (NDI), xylylene diisocyanate (XDI), 4,4'-diphenylmethane diisocyanate (MDI), carbodiimide-modified MDI, polymethylene polyphenyl polyisocyanate, polymeric polyisocyanate and so on. These may be used alone or in combination of two or more.

A blending amount of the polyisocyanate is not particularly restricted and may be appropriately selected according to purpose. For example, it is in a range of 1.0 to 3.0 as an equivalent ratio of the isocyanate group in the polyisocyanate to the hydroxyl group in the polyol (NCO/OH).

—Catalyst—

The catalyst is not particularly restricted, and it may be appropriately selected from heretofore known conventional catalysts used in an urethanization reaction according to purpose. Examples thereof include amine-based catalysts, organometallic catalyst and so on.

Examples of the amine-based catalysts include triethylenediamine, dimethylethanolamine, bis(dimethylamino)ethyl ether and so on.

Examples of the organometallic catalyst include dioctyltin, distearyl tin dibutyrate and so on.

The catalyst may be a reactive catalyst such as dimethylaminoethanol having active hydrogen.

These may be used alone or in combination of two or more.

A blending amount of the catalyst is not particularly restricted and may be appropriately selected according to purpose. For example, it is 0.01 parts by mass to 20 parts by mass with respect to 100 parts by mass of the polyol.

By selecting an appropriate type of the catalyst and by controlling its used amount, a cell-wall width, an open-cell diameter, hardness, aeration amount and so on of the foam layer may be adjusted.

—Foaming Agent—

The foaming agent is not particularly restricted and may be appropriately selected according to purpose. Examples thereof include water, Freon compounds, low-boiling-point hydrocarbon compounds and so on. These may be used alone or in combination of two or more.

Examples of the Freon compounds include HCFC-141b, HFC-134a, HFC-245fa, HFC-365mfc and so on.

Examples of the low-boiling-point hydrocarbon compounds include cyclopentane, n-pentane, iso-pentane, n-butane and so on.

A blending amount of the foaming agent is not particularly restricted and may be appropriately selected according to purpose. For example, it is 5 parts by mass to 50 parts by mass with respect to 100 parts by mass of the polyol.

By selecting an appropriate type of the foaming agent and by controlling its used amount, a cell-wall width, an open-cell diameter, hardness, aeration amount and so on of the foam layer may be adjusted. —Other Components—

The other components are not particularly restricted and may be appropriately selected according to purpose. Examples thereof include a foam stabilizer, a cross-linking agent, a foam breaker, a conductive agent, an antistatic agent, a flame retardant, a thinning agent, a pigment, a stabilizer, a colorant, an anti-aging agent, an ultraviolet absorber, an antioxidant and so on. These may be used alone or in combination of two or more.

The foam stabilizer is not particularly restricted and may be appropriately selected according to purpose. Examples thereof include a silicone surfactant and so on.

A commercial product may be used as the silicone surfactant. Specific examples of the commercial product include: dimethylsiloxane foam stabilizers (for example, "SRX-253" manufactured by Dow Corning Toray Co., Ltd., "F-122" manufactured by Shin-Etsu Chemical Co., Ltd. and so on); and polyether-modified dimethylsiloxane foam stabilizers (for example, "L-5309", "SZ-1311", manufactured by Nippon Unicar Co., Ltd. and so on). These may be used alone or in combination of two or more.

A blending amount of the foam stabilizer is not particularly restricted and may be appropriately selected according to purpose. For example, it is 0.2 parts by mass to 10 parts by mass with respect to 100 parts by mass of the polyol.

The cross-linking agent and the foam breaker are formulated for the purpose of controlling isolation and continuity of cells in the foam layer.

The cross-linking agent is not particularly restricted and may be appropriately selected according to purpose. Nonetheless, examples thereof include triethanolamine, dethanolamine and so on.

The foam breaker is not particularly restricted and may be appropriately selected according to purpose. Examples thereof include the foam stabilizers having high foam-breaking property.

A blending amount of the cross-linking agent or the foam breaker is not particularly restricted and may be appropriately selected according to purpose.

Usually, components other than the polyisocyanate are mixed in advance, which is used by mixing with the polyisocyanate components right before molding.

A structure of the foam layer is not particularly restricted and may be appropriately selected according to purpose. Examples thereof include a structure of isolated cells, a structure of continuous cells, and a mixed structure thereof.

Figure 1B:
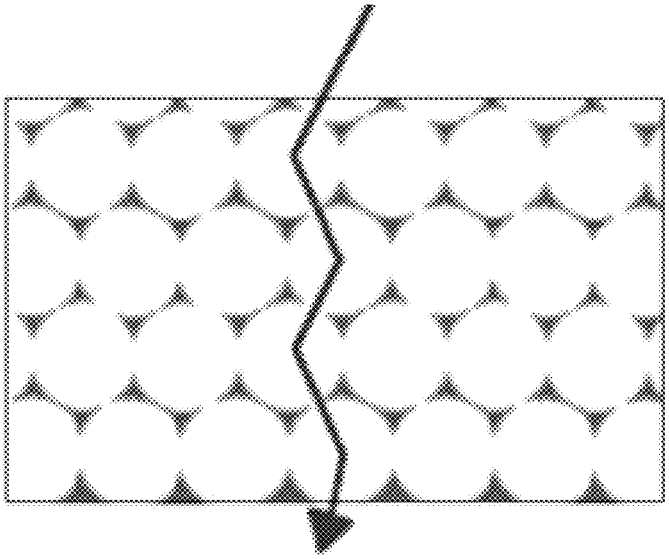
FIG. 1B is a schematic cross-sectional diagram illustrating one example of a foam layer of continuous cells.
Figure 1C:
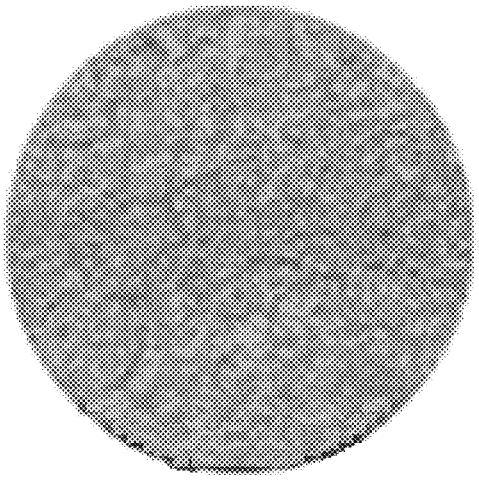
FIG. 1C is a photograph illustrating one example of a foam layer of isolated cells.
Figure 1D:
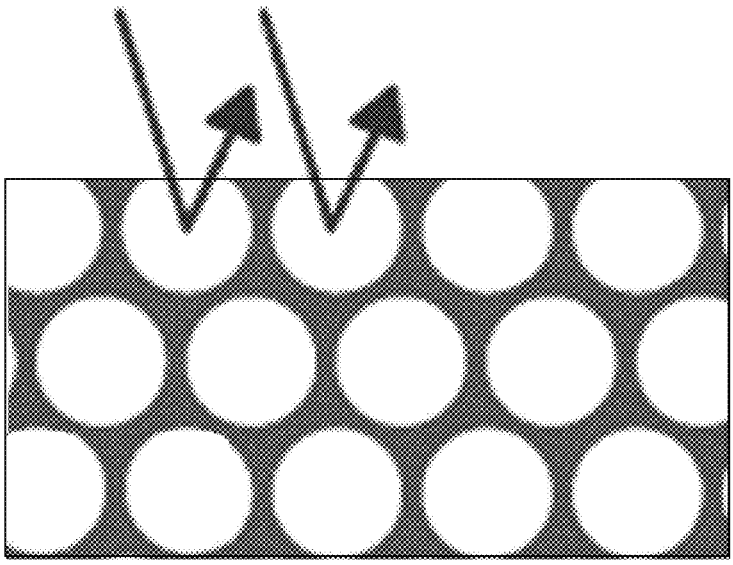
FIG. 1D is a schematic cross-sectional diagram illustrating one example of a foam layer of isolated cells.

FIG. 1A is a photograph of one example of the foam layer of continuous cells. FIG. 1B is a schematic cross-sectional diagram of one example of the foam layer of continuous cells. Since adjacent cells in the foam layer of continuous cells are interconnected, it has a structure which passes through air and water as shown by an arrow in FIG. 1B. FIG. 1C is a photograph of one example of the foam layer of isolated cells. FIG. 1D is a schematic cross-sectional diagram of one example of the foam layer of isolated cells. Cells are isolated in the foam layer of isolated cells, and it has a structure which does not pass through air and water as shown by arrows in FIG. 1D.

Among these, the foam layer of continuous cells is preferable since it has small compressive residual strain and easily returns to its original shape after compression and thus it hardly deforms even in long-term use. Also, compared to the foam layer of isolated cells, powder of the protective agent is less likely to fly by rubbing the foam layer of continuous cells. Since it is advantageous in terms of cost and is able to protect the image bearing member evenly and sufficiently only with a small supplied amount of the protective agent (scraped amount of the protective agent block), the foam layer of continuous cells may prevent filming of the image bearing member. Further, since a size of the protective agent block may be reduced, it is also advantageous for downsizing of the apparatus.

An average cell diameter of the foam layer is not particularly restricted and may be appropriately selected according to purpose. Nonetheless, it is preferably 100 μm to 1,200 μm.

The average cell diameter of the foam layer may be measured, for example, by a laser microscope (VK9500, manufactured by Keyence Corporation).

A number of cells per 1 inch of the foam layer m is not particularly restricted and may be appropriately selected according to purpose. Nonetheless, it is preferably 40 cells/inch to 100 cells/inch. When the number of cells m is less than 40 cells/inch, there are cases where the image bearing member protective agent may not be efficiently applied even though a linear velocity difference between the image bearing member and the protective agent supplying member is increased. When it exceeds 100 cells/inch, hardness of the foam layer may increase. When the linear velocity difference is provided between the image bearing member and the protective agent supplying member, large hardness raises respective driving torques.

Figure 2A:
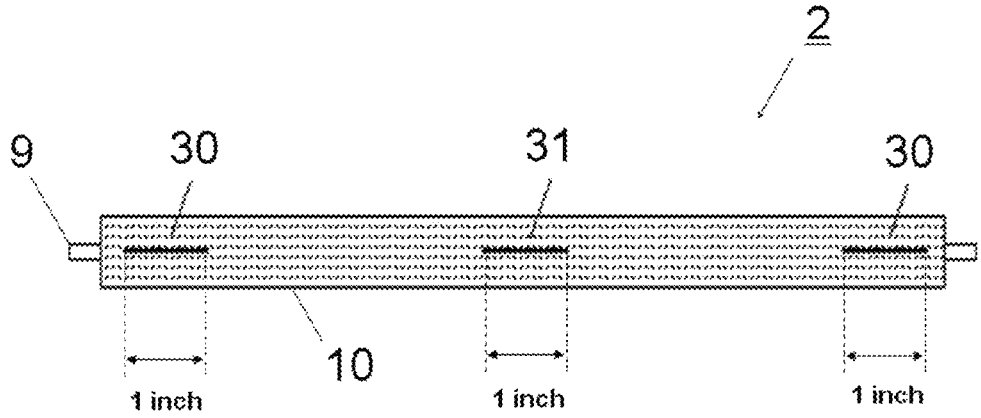
FIG. 2A is a side view illustrating one example of a protective agent supplying member.
Figure 2B:
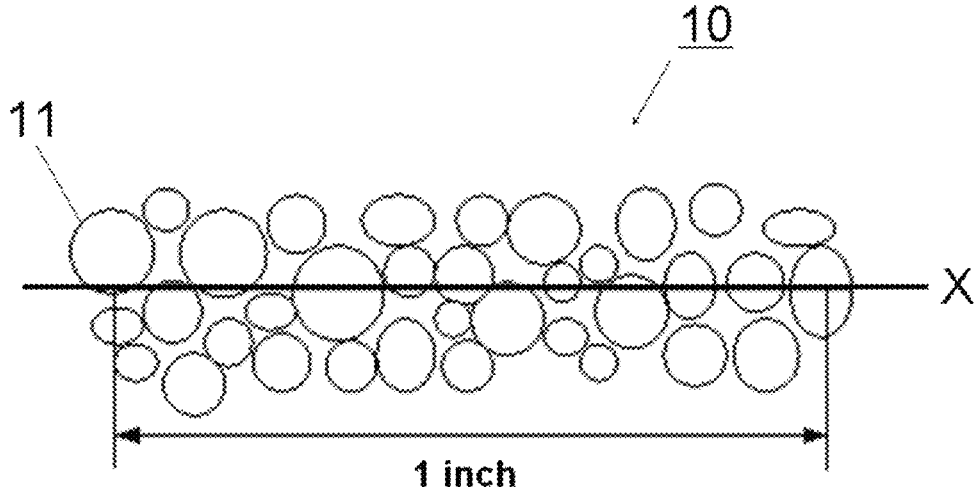
FIG. 2B is an enlarged schematic diagram illustrating one example of an exposed surface of a foam layer of continuous cells.

Here, a method for measuring the number of cells per 1 inch of the foam layer m is explained using FIG. 2A and FIG. 2B. FIG. 2A is a side view illustrating one example of a protective agent supplying member (2) including a foam layer (10) provided on an outer periphery of a core material (9). FIG. 2B is an enlarged schematic diagram illustrating one example of an exposed surface of a foam layer (10) of continuous cells where a plurality of cells (11) adjacent to one another are continuous. Here, in the present specification, 1 inch means 25.4 mm.

As illustrated in FIG. 2A, on a surface of the foam layer (10), three points are arbitrarily selected as measurement points at end portions and central portion in an axial direction of the protective agent supplying member (2). Here, in FIG. 2A, a reference numeral (30) denotes the measurement points at ends, and a reference numeral (31) denote the central portion of the measurement point. Next, at each of the measurement points (30, 31), 2 more points (not shown) are further selected in a circumferential direction of the protective agent supplying member (2), and 9 measurement points in total are determined. Next, using a microscope (for example, DIGITAL MICROSCOPE VHX-100, manufactured by Keyence Corporation), a photo screen at each measurement point is observed.

Thereafter, as illustrated in FIG. 2B, a line (X) having a length corresponding to 1 inch (25.4 mm) in a real scale at a central portion of the photo screen is drawn, a number of cells existing on the line (X) (11) is counted, and an average value of the numbers of cells at 9 measurement points was obtained. This is regarded as the number of cells m (cells/inch).

Here, the cells (11) existing on the line (X) includes not only the cells (11) penetrated by the line (X) but also all the cells (11) which contact the line (X) even though only a part of an outer periphery of the cells (11) is in contact with the line (X) are counted.

For example, in the example of FIG. 2B, the number of cells m is 12 cells/inch.

Here, the 1 inch in measuring the number of cells m is 1 inch in the axial direction in the above-described measurement method as illustrated in the measurement points (30, 31) in FIG. 2A since it is calculated from a plane photo. However, in a method for manufacturing a protective agent supplying member described hereinafter, the protective agent supplying member is that a part of foam prepared beforehand is cur out and wrapped around the core material, and a number of cells per 1 inch in an axial direction of the protective agent supplying member and a number of cells per 1 inch in a circumferential direction of the protective agent supplying member are substantially the same.

Next, a method for calculating the number of cells n existing at a contact portion (hereinafter, it may also be referred to as "nip") between a surface of the image bearing member and the protective agent supplying member at a cross-sectional surface of the image bearing member and the protective agent supplying member in a circumferential direction is explained using a diagram.

Figure 3:
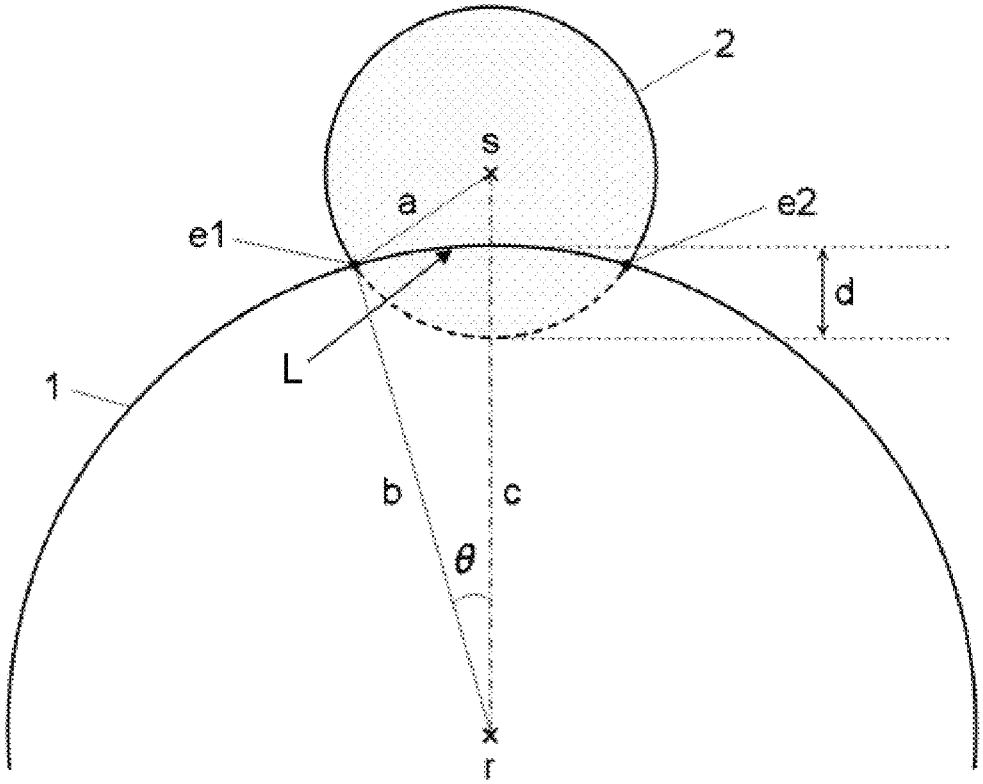
FIG. 3 is a schematic cross-sectional diagram for explaining a state where a protective agent supplying member and a surface of an image bearing member is in contact.

FIG. 3 is a schematic cross-sectional diagram for explaining a condition where a protective agent supplying member (2) and a surface of an image bearing member (1) is in contact. In FIG. 3, "a" represents a radius (mm) of the protective agent supplying member (2); "b" represents a radius (mm) of the image bearing member (1); and "d" represents a biting amount (mm) of the image bearing member (1) against the protective agent supplying member (2). Also, "e1" represents a first contact between an outer periphery of the image bearing member (1) and an outer periphery of the protective agent supplying member (2) in the schematic cross-sectional diagram (hereinafter, it may also be referred to as a "nip portion (e1)"); and "e2" represents a second contact between the outer periphery of the image bearing member (1) and the protective agent supplying member (2) in the schematic cross-sectional diagram (hereinafter, it may also be referred to as a "nip portion (e2)"). Also, "θ" represents an angle (°) formed by the radius of the image bearing member (1) as the line (b) connecting a central portion (r) of the image bearing member (1) and the nip portion (e1) and a line (c) connecting the central portion (r) of the image bearing member (1) and a central portion (s) of the protective agent supplying member (2) in the schematic cross-sectional diagram. In FIG. 3, "L" represents a length (mm) on the outer periphery of the protective agent supplying member (2) between the nip portion (e1) and the nip portion (e2) within the overlapping portion of the image bearing member (1) and the protective agent supplying member (2) (hereinafter, it may also be referred to as a "nip distance (L)").

Here, the nip distance (L) may be measured by marking the nip portion (e1) and the nip portion (e2) of the image bearing member (1) on the image bearing member (1), and thus it is possible to obtain the angle (θ) formed by the line (b) and the line (c) from Equation 1 below. Next, the biting amount (d) may be obtained from Equation 2. Further, using these parameters, the number of cells n may be calculated from Equation 3. Here, in the present invention, the number of cells n is an average value of three measurements at arbitrary locations in an axial direction of the protective agent supplying member.

$$L=2\times b\times\pi\times(2\times\theta/360) \quad \text{(Equation 1)}$$

$$a^2=b^2+(a+b-d)^2-2b(a+b-d)\times\cos\theta \quad \text{(Equation 2)}$$

$$\text{Number of cells } n(\text{cells})=m(\text{cells/inch})/25.4\times L(\text{mm}) \quad \text{(Equation 3)}$$

Here, in Equation 3, 1 inch=25.4 mm.

The number of cells n in the image forming apparatus is not particularly restricted as long as it is greater than 9 and less than 23, and may be appropriately selected according to purpose. Nonetheless, it is preferably greater than 12 and less than 19. When the number of cells n is 9 or less, there is less asperity attributed to the cells due to fewer cells, which reduces contact probability between the cells and the image bearing member. Accordingly, the protective agent scraped by the cells cannot be adhered to (passed to) the image bearing member, and as a result, a rate of supplying the protective agent degrades. Also, when the number of cells n is 23 or greater, there is too much asperity attributed to the cells due to too many cells, and the protective agent supplied on the image bearing member is scraped off again by the cells. As a result, there are cases where an amount of the protective agent required for protecting the image bearing member should be increased.

On the other hand, when the number of cells n is greater than 9 and less than 23, frequency of contact between the image bearing member and the protective agent supplying member is maintained at a high level. Thus, more protective agent may be passed to the image bearing member, and moreover, it is possible to suppress the protective agent once coated on the image bearing member being scraped off (being recovered). Accordingly, the surface of the image bearing member may be protected with a small amount of the protective agent, which is advantageous in view of less consumption of the protective agent.

An average thickness of the foam layer is not particularly restricted and may be appropriately selected according to purpose. Nonetheless, it is preferably 1 mm to 4 mm. When the average thickness is less than 1 mm, it is likely to be affected by the shaft (core material). When it exceeds 4 mm, the scraped amount of the protective agent may decrease.

Here, when the foam layer is cylindrical, the thickness is determined as a distance between an inner peripheral surface and an outer peripheral surface of the cylinder. Here, the average thickness is an average value of measurement values of arbitrarily selected 3 points.

Hardness of the foam layer is not particularly restricted and may be appropriately selected according to purpose. Nonetheless, it is preferably 40N to 430N, and more preferably 40N to 300N. When the hardness is less than 40N, it may become difficult to suppress contamination of the image bearing member. When it exceeds 430N, it may become difficult to suppress contamination of the image bearing member. The hardness of within the more preferable range is advantageous because suppression of contamination of the image bearing member is superior.

The hardness is an average value of values measured based on JIS K 6400 at an arbitrary 3 locations on a surface of the foam layer.

The structure of the cells (continuous cells or isolated cells) and the number of the cells m in the foam layer, and the hardness of the foam layer may be controlled by adjusting appropriately a type of the foamed polyurethane material, an amount of the foaming agent, reaction conditions and so on in manufacturing the foam layer.

Method for Manufacturing Protective Agent Supplying Member—

A method for manufacturing the protective agent supplying member is not particularly restricted and may be appropriately selected according to purpose.

As one example of the method for manufacturing the protective agent supplying member, a production example with the foamed polyurethane as a material of the foam layer is explained.

A commercial product may be used as the foamed polyurethane, or it may be manufactured by a heretofore known method. Examples of the method for manufacturing the foamed polyurethane include a method for forming block-shaped foamed polyurethane by foaming and curing a material of foamed polyurethane by a heretofore known method.

Next, the foamed polyurethane is cut out in a desired shape, a surface thereof is polished according to necessity, it is processed into a cylinder having open cells on a surface thereof, and the core material is inserted in the cylinder. Thereafter, the foamed polyurethane may be cut to a predetermined thickness using a grinding machine and a cutting machine according to necessity by applying a polishing blade to the foamed polyurethane being rotated and by sliding the blade in parallel with an axial direction of the protective agent supplying member (traverse grinding). Thereby, a cylindrical protective agent supplying member having open cells on a surface thereof is obtained. Further, by varying a rotational speed or a traveling speed of the protective agent supplying member, irregular asperity may be formed on the surface of the foam layer.

An adhesive may be applied on the core material beforehand in order to enhance adhesion with the foam layer. By these steps, the protective agent supplying member is manufactured.

Also, another example of the method for manufacturing the protective agent supplying member is explained.

A material for foamed polyurethane is injected in a molding die containing the core material for molding a protective agent supplying member, which is subjected to foaming and curing. Thereby, the protective agent supplying member is manufactured.

Among these manufacturing methods, the method of using a molding die is preferable since it forms the foam layer and makes openings on a surface thereof at the same time with favorable machine accuracy.

In the manufacturing method using a molding die, it is preferable to provide a releasing layer of a fluororesin coating agent, releasing agent and so on an internal surface of the molding die since it is possible to form the foam layer having favorable opening without requiring complex processing.

<<Protective Agent>>

The protective agent includes at least a metal salt of a fatty acid and an inorganic lubricant, and it further includes other components according to necessity.

—Metal Salt of Fatty Acid—

The metal salt of a fatty acid is not particularly restricted and may be appropriately selected according to purpose. Examples thereof include metal stearate, metal oleate, metal palmitate, metal caprylate, metal linolenate, metal ricinoleate and so on. These may be used alone or in combination of two or more.

Examples of the metal stearate include barium stearate, lead stearate, iron stearate, nickel stearate, cobalt stearate, copper stearate, strontium stearate, calcium stearate, cadmium stearate, magnesium stearate, zinc stearate and so on.

Examples of the metal oleate include zinc oleate, magnesium oleate, iron oleate, cobalt oleate, copper oleate, lead oleate, manganese oleate and so on.

Examples of the metal palmitate include zinc palmitate, cobalt palmitate, lead palmitate, magnesium palmitate, aluminum palmitate, calcium palmitate and so on.

Examples of the metal caprylate include lead caprylate and so on.

Examples of the metal linolenate include zinc linolenate, cobalt linolenate, calcium linolenate and so on.

Examples of the metal ricinoleate include zinc ricinoleate, cadmium ricinoleate and so on.

Among these, materials having lamella crystals are favorable as the metal salt of a fatty acid. This is because the materials have a layered structure in which amphiphilic molecules are self-organized, where the crystals are cracked along an interlayer with an application of a shear force and easily slide, and thus they have superior lubricity. Metal stearates are preferable, and zinc stearate is more preferable since they cover relatively uniformly a surface of the image bearing member, protect favorably from electrical stresses in the charging step, and are superior in suppressing contamination of the image bearing member.

A content of the metal salt of a fatty acid in the protective agent is not particularly restricted and may be appropriately selected according to purpose.

—Inorganic Lubricant—

The inorganic lubricant is not particularly restricted and may be appropriately selected according to purpose. Examples thereof include mica, boron nitride, molybdenum disulfide, tungsten disulfide, talc, kaolin, montmorillonite, calcium fluoride, graphite and so on. These may be used alone or in combination of two or more. Among these, as the inorganic lubricant, boron nitride, mica and talc are preferable, and boron nitride is more preferable in view of superior suppression of contamination of a charging member.

A content of the inorganic lubricant in the protective agent is not particularly restricted and may be appropriately selected according to purpose.

A content ratio of the metal salt of a fatty acid and the inorganic lubricant in the protective agent is not particularly restricted and may be appropriately selected according to purpose. Nonetheless, metal salt of a fatty acid: inorganic lubricant as a mass ratio is preferably 100:0 to 50:50, and more preferably 90:10 to 60:40. When the metal salt of a fatty acid is less than 50:50 of the content ratio, there are cases where it becomes difficult to form the protective layer on the image bearing member. The content ratio of within the more preferable range is advantageous since suppression of contamination of the image bearing member and contamination of the charging member is superior.

A size and a shape of the protective agent are not particularly restricted and may be appropriately selected according to purpose. Examples of the shape include a bar shape such as rectangular column and cylindrical column. Among these, the rectangular column is preferable as the shape of the protective agent.

—Molding Method—

A molding method of the protective agent is not particularly restricted and may be appropriately selected according to purpose. Examples thereof include a melt-molding method, a compression-molding method and so on. Here, in general, a protective agent molded by the melt-molding method is translucent while a protective agent molded by the compression-molding method is white, and thus these are visually distinguishable.

Among these, as the molding method of the protective agent, the compression molding method is preferable.

Figure 4A:
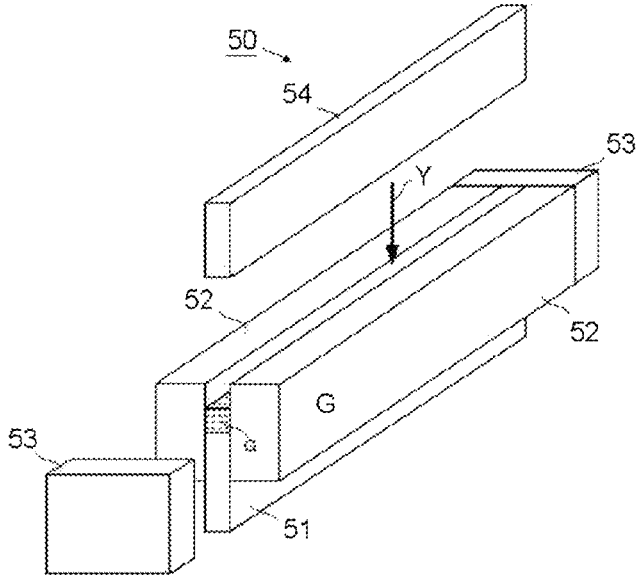
FIG. 4A is a perspective diagram illustrating one example of a step for forming a protective agent block by compression molding using a manufacturing apparatus of an image bearing member protective agent.
Figure 4B:
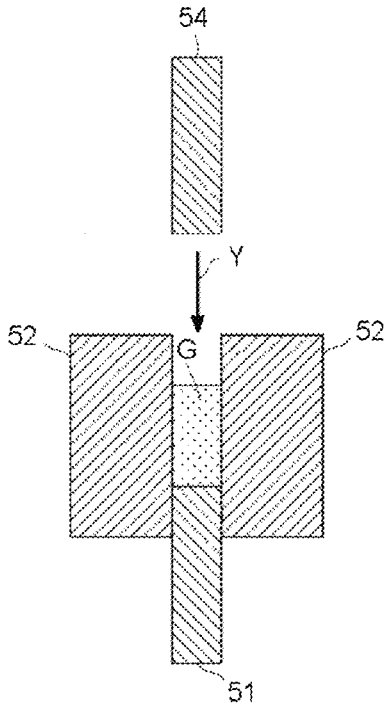
FIG. 4B is a schematic cross-sectional diagram of the manufacturing apparatus of the image bearing member protective agent in FIG. 4A.

One example of the compression molding method is explained using diagrams. FIG. 4A is a perspective diagram illustrating one example of a step for forming a protective agent block by compression molding using a protective agent manufacturing apparatus. FIG. 4B is a schematic cross-sectional diagram of the manufacturing apparatus illustrated in FIG. 4A. FIG. 4D is a schematic cross-sectional diagram illustrating one example of a protective agent block fixed on a holder.

As illustrated in FIG. 4A and FIG. 4B, the protective agent manufacturing apparatus (50) includes: a lower mold (51); a pair of side molds (52) arranged to sandwich the lower mold (51) and forms side surfaces that extend in a longitudinal direction of the protective agent; a pair of edge molds (53) arranged to sandwich the lower mold (51) and the side molds (52) and form side surfaces of the protective agent block in a longitudinal direction; and an upper mold (54).

In FIG. 4A, one of the edge molds (53) is illustrated in a decomposed state, but it actually occupies a position opposite to the other edge mold (53). During compression molding of the protective agent described below, a closed space is formed by the edge molds (53), the lower mold (51) and the side molds (52) excluding the space from which the upper mold (54) enters. Also, in FIG. 4A and FIG. 4B, as indicated by an arrow (Y), when the upper mold (54) moves and enters the closed space, a complete closed space is formed by the lower mold (51), the side molds (52), the edge molds (53) and the upper mold (54).

With the upper mold (54) removed, a powder (G) as a raw material of the protective agent is filled in the space formed. The powder (G) may be particulate or granular, or a mixture thereof.

Once the introduction of the powder (G) is completed, the upper mold (54) is entered from a direction of the arrow (Y) to the closed space. While forming a complete closed space, a block of the protective agent is formed by pressurization.

Figure 4C:
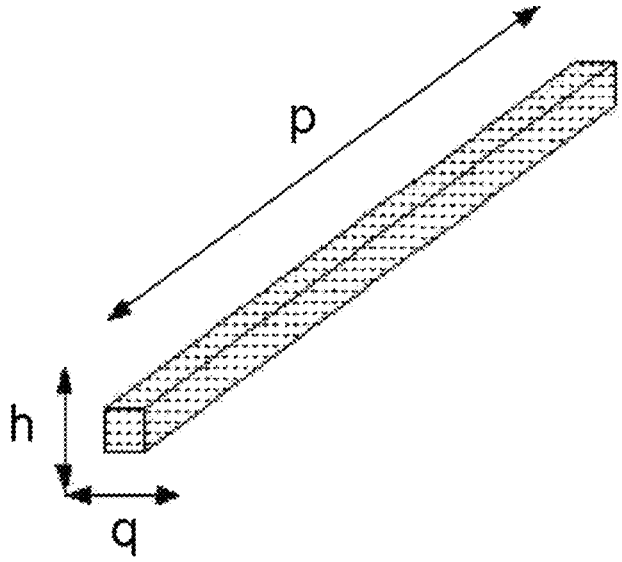
FIG. 4C is a perspective diagram illustrating one example of a protective agent block molded by compression molding.
Figure 4D:
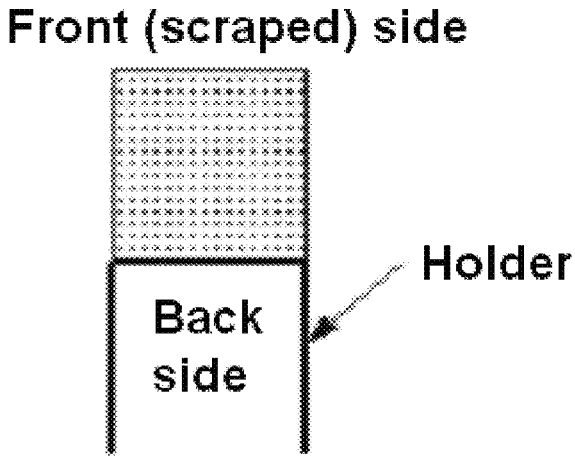
FIG. 4D is a schematic cross-sectional diagram illustrating one example of a protective agent block fixed on a holder.

By the above step, a protective agent block of a rectangular column illustrated in FIG. 4C is molded by compression molding. The protective agent block molded thereby is fixed on a holder as illustrated in FIG. 4D, which is provided in the image forming apparatus.

A size of such a protective agent block of a rectangular column is not particularly restricted, and it may be appropriately selected depending on a width of a recording medium output by the image forming apparatus and so on.

<<Other Members>>

The other members in the protective layer forming unit are not particularly restricted and may be appropriately selected according to purpose. Examples thereof include a protective layer forming member, a pressure-imparting member and so on.

—Protective Layer Forming Member—

The protective agent is relatively easy to deform plastically since it develops a protective effect by adhering on a surface of an image bearing member to form a film. Thus, when a massive image bearing member protective agent component is directly pressed to a surface of the image bearing member to form a protective layer, a supply thereof becomes excessive. This not only reduces efficiency of protective layer formation but also forms multi-layer protective layer and becomes a factor of inhibiting light transmission in forming an electrostatic latent image in an exposing step. Thus, there are cases where types of usable image bearing member protective agent are restricted. On the other hand, arrangement of a protective layer forming member between the image bearing member protective agent and the image bearing member is advantageous since it may be uniformly supplied on a surface of the image bearing member even when a flexible image bearing member protective agent is used.

The protective layer forming member is not particularly restricted as long as it thins the protective agent provided on a surface of the image bearing member to form a protective layer, and it may be appropriately selected according to purpose. Examples thereof include a blade.

A material of the blade is not particularly restricted and may be appropriately selected according to purpose. Examples thereof include a urethane rubber, a hydrin rubber, a silicone rubber, a fluorine-containing rubber and so on.

These may be used alone or in combination of two or more.

A portion of the blade of these materials that contacts the image bearing member may be subjected to coating or impregnation treatment with a material having a low frictional coefficient. Also, fillers such as organic filler and inorganic filler may be dispersed for adjusting hardness of the blade.

A thickness of the elastic metal blade is not particularly restricted and may be appropriately selected according to purpose. Nonetheless, it is preferably 0.05 mm to 3 mm, and more preferably 0.1 mm to 1 mm. The elastic metal blade may be subjected to processes such as bending work in a direction substantially perpendicular to a shaft after installation in order to prevent the blade from twisting.

The blade is fixed on a blade substrate by any method such as adhesion and fusion so that it presses a surface of the image bearing member in a contact manner. A thickness of the blade is not unambiguously defined in view of a force applied by pressing. Nonetheless, it is preferably 0.5 mm to 5 mm, and more preferably 1 mm to 3 mm.

Also, the same applies to a length of the blade which protrudes from the blade substrate to have a deflection, a so-called free length, and it is not unambiguously defined in view of a force applied by pressing. Nonetheless, it is preferably 1 mm to 15 mm, and more preferably 2 mm to 10 mm.

The protective layer forming member may also serve as a cleaning member. However, in order to form the protective layer more reliably, it is preferable to remove beforehand a residue with a toner as a main component on the image bearing member by a cleaning member so that the residue is not mixed in the protective layer.

—Pressure-Imparting Member—

The pressure-imparting member is a member which presses the protective layer forming member to a surface of the image bearing member.

For example, a coating layer such as resin, rubber and elastomer is formed by a method such as coating and dipping on a surface of an elastic metal blade such as spring plate via a coupling agent or a primer component according to necessity, which is thermally cured according to necessity, and further is subjected to surface polishing according to necessity.

The coating layer includes at least a binder resin and a filler, and it further includes other components according to necessity.

The binder resin is not particularly restricted and may be appropriately selected according to purpose. Examples thereof include: a fluororesin such as perfluoroalkoxyalkane (PFA), polytetrafluoroethylene (PTFE), copolymer of tetrafluoroethylene-hexafluoropropylene (FEP), polyvinylidene fluoride (PVdF) and so on; and a silicone elastomer such as fluorine-containing rubber, methylphenylsilicone elastomer and so on.

In the pressure-imparting member, as a pressing force of the protective layer forming member on the image bearing member, a force which makes the protective agent for an image bearing member to spread in a form of a protective layer suffices, and it is, as a linear pressure, preferably 5 gf/cm to 80 gf/cm, and more preferably 10 gf/cm to 60 gf/cm.

<Rotational Speed Controlling Unit>

The rotational speed controlling unit is not particularly restricted as long as it controls a rotational speed of the protective agent supplying member, and it may be appropriately selected according to purpose. The protective agent supplying member may also serve as a function of the rotational speed controlling unit, or it may be provided as a separate member (device).

The rotational speed controlling unit is not particularly restricted and may be appropriately selected according to purpose. Examples thereof include a CPU (Central Processing Unit) mounted on the image forming apparatus and so on.

The rotational speed controlling unit controls a traveling speed V of the cells at a contact portion (nip) between surfaces of the image bearing member and the protective agent supplying member relative to a surface of the image bearing member in a cross-sectional surface of the image bearing member and the protective agent supplying member in a circumferential direction to be greater than 837 cells/mm$^2$/s and less than 4,670 cells/mm$^2$/s. The traveling speed V is not particularly restricted as long as it is within a range greater than 837 cells/mm$^2$/s and less than 4,670 cells/mm$^2$/s, and it may be appropriately selected according to purpose. Nonetheless, it is more preferably greater than 3,000 cells/mm$^2$/s and less than 4,670 cells/mm$^2$/s, and particularly preferably greater than 4,000 cells/mm$^2$/s and less than 4,670 cells/mm$^2$/s. When the traveling speed V is 837 cells/mm$^2$/s or less, an amount of the protective agent supplied to the image bearing member may be insufficient. When it is 4,670 cells/mm$^2$/s or greater, removal power of the protective agent on a surface of the image bearing member, and as a result, a supplied amount of the protective agent may be insufficient.

On the other hand, when the traveling speed V is within the preferable range, more protective agent may be provided to the image bearing member, and, moreover, it is possible to suppress the protective agent once applied on the image bearing member being scraped off (being recovered). It is accordingly advantageous since the surface of the image bearing member may be protected only with a small amount of the protective agent and thus consumption of the protective agent is small.

The traveling speed of cells V (cells/mm$^2$/s) may be calculated from the number of cells n using Equation 4 below.

$$\text{Traveling speed of cells } V(\text{cells/mm}^2/\text{s}) = [\text{number of cells } n(\text{cells})/1\ (\text{inch})]^2 \times \text{linear velocity difference } Z \quad \text{(Equation 4)}$$

Here, in Equation 4, 1 inch=25.4 mm.

The calculation method of the traveling speed of cells V is explained with a case where the number of cells n is 50 as an example.

$$[\text{Number of cells } n\ (\text{cells})/1\ (\text{inch})]^2 = [50\ (\text{cells})/25.4(\text{mm})]^2 = 3.88\ (\text{cells/mm}^2)$$

Here, 3.88 (cells/mm$^2$) means that there are 1.97 (cells/mm) cells in both a circumferential direction and an axial direction of the protective agent supplying member. By dividing this by the linear velocity difference Z, traveling speed of cells V (cells/mm$^2$/s) may be calculated.

Here, in Equation 4, the linear velocity difference Z means a difference between a linear velocity (mm/s) of the protective agent supplying member and a linear velocity (mm/s) of the image bearing member, and it is calculated from Equation 5 below.

$$\text{Linear velocity difference } Z(\text{mm/s}) = \text{linear velocity (mm/s) of protective agent supplying member} + \text{linear velocity (mm/s) of image bearing member} \quad \text{(Equation 5)}$$

The linear velocity (mm/s) of the protective agent supplying member is not particularly restricted and may be appropriately selected according to purpose. Nonetheless, it is preferably 50 mm/s to 500 mm/s, and more preferably 100 mm/s to 300 mm/s. When the linear velocity (mm/s) of the protective agent supplying member is less than 50 mm/s, it is necessary to increase the pressing force to the protective agent supplying member because scraping power of the protective agent decreases, which may cause an increase in torque. When the linear velocity (mm/s) of the protective agent supplying member exceeds 500 mm/s, there are cases where a torque of the photoconductor or a torque of the protective agent supplying member increases or where life of various parts including the photoconductor, the protective agent supplying member and so on in the image forming apparatus are shortened.

The linear velocity (mm/s) of the protective agent supplying member may be determined by calculating from measurements of an outer diameter (mm) and a rotational speed (rpm) of the supplying member.

The linear velocity (mm/s) of the image bearing member is not particularly restricted and may be appropriately selected according to purpose. Nonetheless, it is preferably 30 mm/s to 500 mm/s. When the linear velocity (mm/s) of the image bearing member is less than 30 mm/s, productivity may degrade. When it exceeds 500 mm/s, there are cases where life of various parts including the photoconductor, the protective agent supplying member and so on in the image forming apparatus may be shortened or where an image defect due to vibration occurs.

The linear velocity (mm/s) of the image bearing member may be determined by calculating from measurements of an outer diameter (mm) and a rotational speed (rpm) of the image bearing member.

The linear velocity difference Z (mm/s) is not particularly restricted and may be appropriately selected according to purpose. Nonetheless, it is preferably 10 mm/s to 1,000 mm/s, and more preferably 50 mm/s to 700 mm/s. When the linear velocity difference Z (mm/s) is less than 10 mm/s, there are cases where the protective agent is not sufficiently supplied to the photoconductor. When it exceeds 1,000 mm/s, a power of removing the protective agent on a surface of the image bearing member also increases, and as a result, a supplied amount of the protective agent may be insufficient.

<Image Bearing Member>

A material, shape, structure, size and so on of the image bearing member are not particularly restricted, and they may be appropriately selected from heretofore known ones. A drum shape is favorable as the shape of the image bearing member. Also, examples of the material of the image bearing member include: an inorganic image bearing member such as amorphous silicon, selenium; and an organic image bearing member such as polysilane, phthalopolymethine. These may be used alone or in combination of two or more.

The image bearing member preferably includes an electrically conductive substrate and at least a photoconductive layer on the electrically conductive substrate, and it further includes other layers such as undercoat layer and outermost surface layer according to necessity. An appropriate amount of a plasticizer, an antioxidant, a leveling agent, etc. may be added to the respective layers according to necessity.

<<Photoconductive Layer>>

The photoconductive layer is not particularly restricted and may be appropriately selected according to purpose. Nonetheless, it preferably includes a charge generating material, a charge transport material, and a binder resin, and it further includes other components according to necessity.

The photoconductive layer is categorized into; a single-layer type that the charge generating material and the charge transport material are mixed; an ordered-layer type that a charge transport layer is disposed on a charge generation layer; or a reverse-layer type that a charge generation layer is disposed on a charge transport layer.

—Charge Generating Material—

The charge generating material is not particularly restricted and may be appropriately selected according to purpose. Examples thereof include; organic pigments or dyes such as azo pigments including monoazo pigments, bisazo pigments, trisazo pigments, tetrakisazo pigments, triarylmethane dyes, thiazine dyes, oxazine dyes, xanthene dyes, cyanine dyes, styryl dyes, pyrylium dyes, quinacridone pigments, indigo pigments, perylene pigments, polycyclic quinone pigments, bisbenzimidazole pigments, indanthrone pigments, squarylium pigments, phthalocyanine pigments and so on; inorganic material such as selenium, selenium-arsenic, selenium-tellurium, cadmium sulfide, zinc oxide, titanium oxide, amorphous silicon and so on. These may be used alone or in combination of two or more.

—Charge Transport Material—

Examples of the charge transport material include anthracene derivatives, pyrene derivatives, carbazole derivatives, tetrazole derivatives, metallocene derivatives, phenothiazine derivatives, pyrazoline compounds, hydrazone compounds, styryl compounds, styrylhydrazone compounds, enamine compounds, butadiene compounds, distyryl compounds, oxazole compounds, oxadiazole compounds, thiazole compounds, imidazole compounds, triphenylamine derivatives, phenylenediamine derivatives, aminostilbene derivatives, triphenylmethane derivatives and so on. These may be used alone or in combination of two or more.

—Binder Resin—

As the binder resin, a thermoplastic resin, a thermosetting resin, a photo-curable resin and a photoconductive resin which are electrically insulating and heretofore known per se may be used. Examples of the binder resin include: a thermoplastic resin such as polyvinyl chloride, polyvinylidene chloride, vinyl acetate-vinyl chloride copolymer, vinyl chloride-vinyl acetate-maleic anhydride copolymer, ethylene-vinyl acetate copolymer, polyvinyl butyral, polyvinyl acetal, polyester, phenoxy resin, (meth)acrylic resin, polystyrene, polycarbonate, polyarylate, polysulfone, polyether sulfone, ABS resin and so on; a thermosetting resin such as phenolic resin, epoxy resin, urethane resin, melamine resin, isocyanate resin, alkyd resin, silicone resin, thermosetting acrylic resin and so on; polyvinylcarbazole, polyvinyl anthracene, polyvinylpyrene and so on. These may be used alone or in combination of two or more.

<<Electrically Conductive Substrate>>

The electrically conductive substrate is not particularly restricted and may be appropriately selected according to purpose. Nonetheless, it preferably demonstrates an electrical conductivity that a volume resistivity thereof is $1.0\times10^{10}$ Ω·cm or less.

For example, those used as such an electrically conductive substrate include: metals such as aluminum, nickel, chrome, nichrome, copper, gold, silver, platinum and so on or metal oxides such as tin oxide, indium oxide and so on coated on a piece of film-shaped or cylindrical plastic or paper; plates of aluminum, aluminum alloy, nickel, stainless steel and so on; and the plates formed into a drum-shaped tube by extruding or drawing, followed by surface treatment such as cutting, super-finishing and polishing.

The drum-shaped substrate is not particularly restricted and may be appropriately selected according to purpose. Nonetheless, it has a diameter of preferably 20 mm to 150 mm, more preferably 24 mm to 100 mm, and particularly preferably 28 mm to 70 mm. When the diameter of the drum-shaped substrate is less than 20 mm, it may become physically difficult to arrange units such as charging unit, exposure unit, developing unit, transfer unit, cleaning unit and so on around the drum. When it exceeds 150 mm, the image forming apparatus may be large. In particular, since a tandem image forming apparatus is required to mount a plurality of image bearing members, a diameter is preferably 70 mm or less, and more preferably 60 mm or less.

Also, an endless nickel belt or an endless stainless-steel belt disclosed in JP-A No. 52-36016 may also be used as the electrically conductive substrate.

<<Undercoat Layer>>

In the image bearing member, an undercoat layer may be disposed between the photoconductive layer and the electrically conductive substrate.

The undercoat layer may be a single-layer or a multilayer. Examples thereof include; (1) a resin as a main component; (2) a white pigment and a resin as main components; and (3) a metal oxide film that a surface of the electrically conductive substrate is chemically or electrochemically oxidized. Among these, the undercoat layer having a white pigment and a resin as main components is preferable.

The white pigment is not particularly restricted and may be appropriately selected according to purpose. Examples thereof include metal oxides such as titanium oxide, aluminum oxide, zirconium oxide, zinc oxide and so on. These may be used alone or in combination of two or more. Among these, titanium oxide is particularly preferable since it is superior in terms of preventing charge injection from the electrically conductive substrate.

The resin is not particularly restricted and may be appropriately selected according to purpose. Examples thereof include: thermoplastic resins such as polyamide, polyvinyl alcohol, casein and methyl cellulose; and thermosetting resins such as acrylic, phenol, melamine, alkyd, unsaturated polyester and epoxy resins. These may be used alone or in combination of two or more.

A thickness of the undercoat layer is not particularly restricted and may be appropriately selected according to purpose. Nonetheless, it is preferably 0.1 μm to 10 μm, and more preferably 1 μm to 5 μm.

—Outermost Surface Layer—

In the image bearing member, an outermost surface layer may be disposed on the photoconductive layer for improving mechanical strength, abrasion resistance, gas resistance, cleanability and so on.

The outermost surface layer is not particularly restricted and may be appropriately selected according to purpose. Nonetheless, it is preferably a polymer compound having mechanical strength greater than the photoconductive layer and a layer that an inorganic filler is dispersed in the polymer compound.

The polymer compound is not particularly restricted and may be appropriately selected according to purpose. Nonetheless, a thermoplastic resin and a thermosetting resin are preferable. The thermosetting resin is more preferable since it has high mechanical strength and may significantly reduce wear due to friction with the cleaning unit, and a thermosetting resin cross-linked by a cross-linking agent having polyfunctional acryloyl group, carboxyl group, hydroxyl group, amino group and so on is particularly preferable.

As the resin used for the outermost surface layer, those which are transparent with respect to a writing light during image formation and having superior insulation property, mechanical strength and adhesion property. Examples thereof include an ABS resin, an ACS resin, an olefin-vinyl monomer copolymer, chlorinated polyether, an allyl resin, a phenolic resin, polyacetal, polyamide, polyamideimide, polyacrylate, polyallyl sulfone, polybutylene, polybutylene terephthalate, polycarbonate, polyether sulfone, polyethylene, polyethylene terephthalate, polyimide, an acrylic resin, polymethylpentene, polypropylene, polyphenylene oxide, polysulfone, polystyrene, an AS resin, butadiene-styrene copolymer, polyurethane, polyvinyl chloride, polyvinylidene chloride, an epoxy resin and so on. These may be used alone or in combination of two or more.

The surface layer having no charge transportability is not a problem, provided that it is thin. However, when the outermost surface layer having no charge transportability is thickly formed, it is likely to cause decrease in sensitivity of the image bearing member, potential increase after exposure, increase in residual potential and so on. Thus, it is preferable to incorporate the charge transport material in the outermost surface layer or to use a polymeric resin having charge transportability in the surface layer.

In general, since mechanical strengths of the photoconductive layer and the outermost surface layer differ greatly. When the outermost surface layer is worn and lost due to friction with the cleaning unit, the photoconductive layer is quickly worn. Accordingly, it is important to have a sufficient thickness when the outermost surface layer is provided.

A specific thickness of the outermost surface layer is preferably 0.1 μm to 12 μm, more preferably 1 μm to 10 μm, and particularly preferably 2 μm to 8 μm. The thickness of less than 0.1 μm is too thin. Thus, a portion thereof is likely to be lost due to friction with the cleaning blade, and wear of the photoconductive layer may proceed from the lost portion. When it exceeds 12 μm, decrease in sensitivity, potential increase after exposure and increase in residual potential are likely to occur. In particular, when a polymer having charge transportability is used, there are cases where the cost of the polymer having charge transportability may be high.

The outermost surface layer preferably has charge transportability. In order to impart charge transportability to the outermost surface layer, it is possible to use a method of using a polymer used for the outermost surface layer mixed with the charge transport material and a method of using a polymer having charge transportability in the outermost surface layer. The latter method is preferable because an image bearing member having high sensitivity and less increases in potential or residual potential after exposure may be obtained therewith.

It is preferable to incorporate metal particles, metal oxide particles and other particles in the outermost surface layer in order to enhance mechanical strength of the outermost surface layer. Examples of the metal oxides include titanium oxide, tin oxide, potassium titanate, titanium nitride, zinc oxide, indium oxide, antimony oxide and so on. Also, as the other particles, fluororesin such as polytetrafluoroethylene, silicone resin, and these resins in which inorganic material are dispersed may be used for the purpose of improving abrasion resistance.

With the image bearing member including the outermost surface layer, changes in the surface condition of the image bearing member may be significantly reduced. It is advantageous since stable cleaning may be carried out over a long period of time even with a toner having a large circularity or a small average particle diameter, with which quality of cleaning is sensitive to a change in a state of the image bearing member. Also, since it increases a water contact angle of the surface of the image bearing member, imparting water repellency to the surface of the image bearing member, it is advantageous in view of preventing water absorption by the surface of image bearing member and suppressing image blurring.

<Other Units>

The other units in the image forming apparatus are not particularly restricted and may be appropriately selected according to purpose. Examples thereof include a charging unit, an exposure unit, a developing unit, a transfer unit, a fixing unit, a neutralizing unit, a cleaning unit, a recycling unit, a controlling unit and so on.

A combination of the image bearing member, the charging unit and the exposure unit may be referred to as an electrostatic latent image forming unit.

Formation of an electrostatic latent image by the electrostatic latent image forming unit may be carried out, for example, by charging a surface of the image bearing member followed by image-wise exposure, and it may be carried out with the electrostatic latent image forming unit.

<<Charging Unit>>

The charging unit is a unit for applying a voltage on a surface of the image bearing member.

The charging unit is not particularly restricted and may be appropriately selected according to purpose. Examples thereof include: a contact or a proximity charger heretofore known per se equipped with an electrically conductive or semiconductive roller, brush, film, rubber blade and so on; and a non-contact charger which makes use of corona discharge such as corotron, scorotron and so on.

The charger preferably includes a voltage applying unit which applies a voltage having an AC component.

Electrical stresses tend to be large with a charging unit arranged in contact with or close to the surface of the image bearing member since discharge region is present in an immediate vicinity of the image bearing member. However, in the image forming apparatus of the present invention, by satisfying the number of cells n, the image bearing member may be advantageously used without exposing it to the electrical stresses.

<<Exposure Unit>>

The exposure unit is a unit for image-wise exposure of the surface of the image bearing member.

The exposure unit is not particularly restricted as long as it may carry out an exposure of an image to be formed on the surface of the image bearing member charged by the charging unit, and it may be appropriately selected according to purpose. Nonetheless, examples thereof include various exposure devices such as duplication optical system, rod lens array system, laser optical system, liquid crystal shutter optical system and so on.

Here, in the present invention, a back-light system where an image-wise exposure is carried out from a back side of the image bearing member may be employed.

<<Developing Unit>>

The developing unit is a unit for developing the electrostatic latent image using a toner or a developer to form a visible image.

The developing unit is not particularly restricted as long as it may develop using the toner or the developer, and it may be appropriately selected from heretofore known ones. For example, those including at least a developing device which contains the toner or the developer and which may provide the toner or the developer to the electrostatic latent image in a contact or a non-contact manner may be favorably used.

The developing device may be of a dry developing method or of a wet developing method, and also it may be a single-color developing device or a multi-color developing device. For example, a favorable developing device includes a stirrer which frictionally stirs to charge a toner or a developer and a rotational magnet roller.

In the developing device, for example, the toner and the carrier are mixed and stirred, by the friction therefrom, the toner is charged and maintained on a surface of the rotating magnet roller in a state of ear standing, and a magnetic brush is formed. Since the magnet roller is arranged near the image bearing member (photoconductor), a part of the toner which constitutes the magnetic brush formed on the magnet roller moves to a surface of the image bearing member (photoconductor) by an electrical attraction force. As a result, the electrostatic latent image is developed by the toner, and a visible image by the toner is formed on the surface of the image bearing member (photoconductor).

The developer contained in the developing device is a developer including the toner, and the developer may be a one-component developer or a two-component developer.

—Toner—

The toner is not particularly restricted and may be appropriately selected according to purpose. Examples thereof include a toner prepared by a polymerization method that a toner composition including a polyester prepolymer having a functional group including a nitrogen atom, a compound which elongates or cross-links with the prepolymer, polyester, a colorant, a releasing agent and so on is subjected to a cross-linking and/or elongation reaction in an aqueous medium in the presence of resin particles. The toner has a surface thereof cured to reduce hot offset, which may suppress the toner becoming contamination of the fixing unit and appearing on an image.

—Polyester Prepolymer—

Examples of the polyester prepolymer having a functional group including a nitrogen atom include a polyester prepolymer having an isocyanate group and so on.

For example, the polyester prepolymer having an isocyanate group is a condensation product of a polyol and a polycarboxylic acid as well as a reaction product of polyester having an active hydrogen group with polyisocyanate.

The active hydrogen group included in the active hydrogen polyester is not particularly restricted and may be appropriately selected according to purpose. Examples thereof include a hydroxyl group (alcoholic hydroxyl group and phenolic hydroxyl group), an amino group, a carboxyl group, a mercapto group and so on. Among these, the alcoholic hydroxyl group is particularly preferable.

The polyol is not particularly restricted and may be appropriately selected according to purpose. Examples thereof include diols, polyols having three or more valences and so on. Among these, a diol alone and a mixture of a diol with a small amount of a polyol having three or more valences are preferable.

The polycarboxylic acid is not particularly restricted and may be appropriately selected according to purpose. Examples thereof include dicarboxylic acids, polycarboxylic acids having three or more valences and so on. Among these, dicarboxylic acid alone and a mixture of a dicarboxylic acid and a small amount of a polycarboxylic acid having three or more valences are preferable.

A ratio of the polyol and the polycarboxylic acid is not particularly restricted and may be appropriately selected according to purpose. Nonetheless, an equivalent ratio of hydroxyl groups [OH] to carboxyl groups [COOH] ([OH]/[COOH]) is preferably 2/1 to 1/1, more preferably 1.5/1 to 1/1, and particularly preferably 1.3/1 to 1.02/1.

Examples of the polyisocyanate include aliphatic polyisocyanates (tetramethylene diisocyanate, hexamethylene diisocyanate, 2,6-diisocyanatomethyl caproate and so on); alicyclic polyisocyanates (isophorone diisocyanate, cyclohexyl diisocyanate and so on); aromatic polyisocyanates (tolylene diisocyanate, diphenylmethane diisocyanate and so on); aromatic aliphatic diisocyanates ($\alpha,\alpha,\alpha',\alpha'$-tetramethylxylylene diisocyanate and so on); isocyanurates; the polyisocyanate blocked by a phenol derivative, an oxime, a caprolactam and so on. These may be used alone or in combination of two or more.

A ratio of the polyisocyanate is not particularly restricted and may be appropriately selected according to purpose. Nonetheless, an equivalent ratio ([NCO]/[OH]) of isocyanate groups [NCO] to hydroxyl groups [OH] of polyester having a hydroxyl group is preferably 5/1 to 1/1, more preferably 4/1 to 1.2/1, and particularly preferably 2.5/1 to 1.5/1. When the equivalent ratio of the [NCO] to the [OH] exceeds 5, there are cases where low-temperature fixing property degrades. When the equivalent ratio of the [NCO] to the [OH] is less than unity, hot-offset resistance degrades due to a decreased urea content in the polyester prepolymer.

Further, a molecular weight of the urea-modified polyester may be adjusted using an elongation terminating agent according to necessity. Examples of the elongation terminating agent include monoamines (diethylamine, dibutylamine, butylamine, laurylamine and so on), or compounds in which these monoamines are blocked (ketimine compounds).

—Compound which Elongates or Cross-Links with Prepolymer—

Examples of the compound which elongates or cross-links with the prepolymer include amines and so on.

Examples of the amines include diamines, polyamines having three or more hydroxyl groups, amino alcohols, aminomercaptans, amino acids, compounds in which these amino groups are blocked. Among these amines, the diamine and a mixture of the diamines and a small amount of the polyamines having three or more hydroxyl groups are preferable.

A circularity of the toner is not particularly restricted and may be appropriately selected according to purpose. Nonetheless, it is preferably 0.93 to 1.00. The circularity of the toner may be calculated from the following equation.

Toner circularity=perimeter of a circle having the same area as a projected area of a particle/perimeter of a projected image of the particle Also, the present invention may be applied to not only a polymerized toner having a configuration appropriate for obtaining a high-quality image but also a toner of an irregular shape by a pulverization method. This case is also advantageous in view of significantly extending the life of the apparatus. Materials constituting such a toner by the pulverization method may be appropriately selected from those usually used as an electrophotographic toner according to purpose.

A ratio of a weight-average diameter (D4) to a number-average diameter (D1) of the toner (D4/D1) is not particularly restricted and may be appropriately selected according to purpose. Nonetheless, it is preferably 1.00 to 1.40.

<Transfer Unit>

The transfer unit is a unit to transfer the visible image to a recording medium. As the transfer unit, a preferable aspect includes: a primary transfer unit which transfers the visible image on an intermediate transfer member to form a composite transfer image; and a secondary transfer unit which transfers the composite transfer image to the recording medium.

The transfer unit (the primary transfer unit, the secondary transfer unit) preferably includes at least a transfer device which peels by electrification the visible image formed on the image bearing member to the recording medium. The transfer unit may be one, or two or more. Examples of the transfer device include a corona transfer device by corona discharge, a transfer belt, a transfer roller, a pressure transfer roller, an adhesive transfer device and so on.

Here, the recording medium is not particularly restricted and may be appropriately selected from heretofore known recording media (recording paper).

The image bearing member may be an intermediate transfer member used for image formation by a so-called intermediate transfer method, where a toner image formed on an image bearing member is subjected to a primary transfer for color overlay and further transferred to a recording medium.

The intermediate transfer member is not particularly restricted, and it may be appropriately selected from heretofore known transfer members according to purpose. Favorable examples thereof include a transfer belt and so on.

The intermediate transfer member is not particularly restricted and may be appropriately selected according to purpose. Nonetheless, a preferable member has an electrical conductivity with a volume resistivity of $1.0\times10^{5}$ ∩·cm to $1.0\times10^{11}$ Ω·cm. The volume resistivity of less than $1.0\times10^{5}$ Ω·cm may involve discharge during transfer of a toner image from the image bearing member to the intermediate transfer member, which may disturb the toner image and cause so-called toner scattering. When it exceeds $1.0\times10^{11}$ Ω·cm, there are cases where counter charge of a toner image remains on the intermediate transfer member after transfer of the toner image from the intermediate transfer member to the recording medium such as paper, and a residual image may appear on a next image.

As the intermediate transfer member, for example, a belt-shaped or cylindrical plastic molded by kneading a thermoplastic resin along with metal oxides such as tin oxide and indium oxide, electrically conductive particles such as carbon black or electrically conductive polymers alone or in combination followed by extruding may be used. Other than this, a resin solution including a thermally cross-linkable monomer or oligomer, with an addition of electrically conductive particles or electrically conductive polymers according to necessity, is subjected to centrifugal molding with heating, and an intermediate transfer member as an endless belt may be obtained.

When a surface layer is provided on the intermediate transfer member, among the surface layer materials used for the outermost surface layer, a composition excluding the charge transport materials may be used with an appropriate combination of electrically conductive materials for resistivity adjustment.

<Fixing Unit>

The fixing unit is a unit that the visible image transferred on the recording medium is fixed. It may be carried out every time a toner of a respective color is transferred on the recording medium, or it may be carried out once when the toners of the respective colors are laminated.

The fixing unit is not particularly restricted and may be appropriately selected according to purpose. Nonetheless, a heretofore known heating and pressurizing unit is preferable. Examples of the heating and pressurizing unit include a combination of a heat roller and a pressure roller, a combination of a heat roller, a pressure roller and an endless belt, and so on.

Usually, the heating in the heating and pressurizing unit is preferably at 80° C. to 200° C.

Here, in the present invention, according to purpose, a heretofore known optical fixing device may be used along with or in place of the fixing unit.

<Neutralizing Unit>

The neutralizing unit is a unit of neutralizing by applying a neutralizing bias on the image bearing member.

The neutralizing unit is not particularly restricted as long as it applies the neutralizing bias on the image bearing member, and it may be appropriately selected from heretofore known neutralizing devices. Examples thereof include a neutralizing lamp and so on.

<Cleaning Unit>

The cleaning unit is a unit of removing the electrophotographic toner remaining on the image bearing member.

The cleaning unit is preferably provided at a downstream side of the transfer unit and an upstream side of the protective layer forming unit.

The cleaning unit is not particularly restricted as long as it removes the electrophotographic toner remaining on the image bearing member, and it may be appropriately selected from heretofore known cleaners. Examples thereof include a magnetic brush cleaner, an electrostatic brush cleaner, a magnetic roller cleaner, a blade cleaner, a brush cleaner, a web cleaner and so on.

<Recycling Unit>

The recycling unit is a unit for recycling the toner removed by the cleaning unit to the developing unit.

The recycling unit is not particularly restricted, and a heretofore known conveying unit may be used.

<Controlling Unit>

The controlling unit is a unit for controlling the above steps.

The controlling unit is not particularly restricted as long as it controls operations of the respective steps, and it may be appropriately selected according to purpose. Examples thereof include devices such as sequencer, computer and so on.

Figure 5:
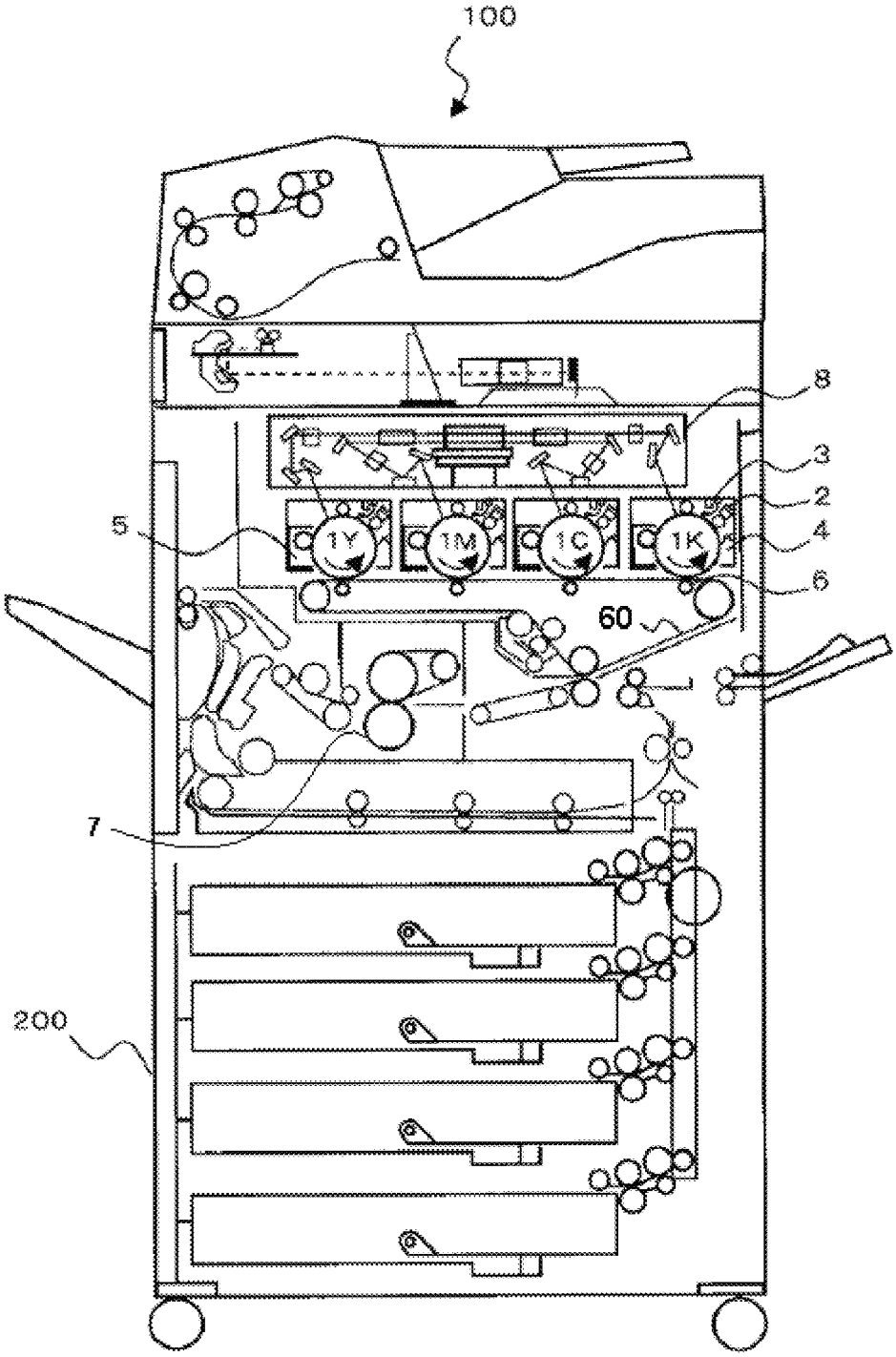
FIG. 5 is a schematic cross-sectional diagram illustrating one example of an image forming apparatus of the present invention.

Hereinafter, one example of an image forming apparatus of the present invention is explained in detail using a diagram, but the present invention is not limited thereto. FIG. 5 is a schematic cross-sectional diagram illustrating one example of an image forming apparatus (100) of the present invention.

Around each of drum-shaped image bearing members (1Y, 1M, 1C, 1K), a protective layer forming unit (2), a charging unit (3), an exposure unit (8), a developing unit (5), a transfer unit (6), and a cleaning unit (4) are arranged.

Next, a series of processes for forming an image is explained using a negative-positive process.

An image bearing member typified by an image bearing member (OPC) including an organic photoconductive layer is neutralized by a neutralizing lamp (not shown), etc. and charged uniformly by a charging unit (3) including a charging member.

When the image bearing member is being charged by the charging unit (3) from a voltage applying mechanism (not shown) to the charging unit (3), a voltage of an magnitude appropriate for charging the image bearing members (1Y, 1M, 1C, 1K) to a desired potential or a charged voltage that this voltage is superimposed by an AC voltage is applied.

The charged image bearing members (1Y, 1M, 1C, 1K) are subjected to a latent image formation with a laser light irradiated by the exposure unit (8) such as laser optical system and so on (an absolute value of a potential at an exposed portion is lower than an absolute value of a potential at a non-exposed portion).

The laser light is emitted from a laser diode and scans a surface of the image bearing members (1Y, 1M, 1C, 1K) by a multifaceted polygonal mirror rotating at a high speed in a direction of axis of rotation.

The latent image formed thereby is developed by toner particles or a developer composed of a mixture of the toner particles and carrier particles supplied on a developing sleeve as a developer bearing member in the developing unit (5), and a toner visible image is formed.

In developing the latent image, a voltage of an appropriate magnitude between an exposed portion and a non-exposed portion of an image bearing members (1Y, 1M, 1C, 1K) or a developing bias that the voltage is superimposed by an AC voltage is applied from a voltage applying mechanism (not shown) to the developing sleeve.

The toner image formed on the image bearing members (1Y, 1M, 1C, 1K) of a corresponding color is transfer on an intermediate transfer member (60) by a transfer unit (6), and the toner image is transferred to a recording medium such as paper fed from a paper-feeding mechanism (200).

At this time, it is preferable that a potential of a polarity opposite to a polarity of a toner charge is applied to the transfer unit (6) as a transfer bias. Thereafter, the intermediate transfer member (60) is separated from the image bearing member, and a transfer image is obtained.

Also, toner particles remaining on the image bearing member is recovered into a toner recovery chamber in the cleaning unit (4) by a cleaning member.

The recording medium transferred is heated by a fixing unit (7), and the toner is fixed on the recording medium.

As the image forming apparatus, an apparatus equipped with a plurality of developing units (5) is used. It may be an apparatus that a plurality of toner images of different colors sequentially prepared by the plurality of developing units (5) is sequentially transferred on a transfer medium and then sent to a fixing unit, where the toner is fixed by heating and so on, or an apparatus that a plurality of toner images similarly prepared is sequentially transferred once on the intermediate transfer member (60), which is collectively transferred on a recording medium such as paper, followed by fixing in a similar manner.

(Protective Layer Forming Apparatus, Method for Forming Protective Layer)

A protective layer forming apparatus of the present invention is a protective layer forming apparatus used in the image forming apparatus of the present invention. It includes at least a protective layer forming unit and a rotational speed controlling unit, and it further includes other units according to necessity. The protective layer forming unit and the rotational speed controlling unit are similar to those explained for the image forming apparatus, and preferable aspects are similar as well.

A method for forming a protective layer of the present invention includes at least a protective layer formation step, and it further includes other steps according to necessity.

Hereinafter, along with an explanation of the protective layer forming apparatus, the method for forming a protective layer is explained.

<Protective Layer Formation Step>

The protective layer formation step is a step for forming a protective layer for protecting a surface of the image bearing member by supplying an image bearing member protective agent on the surface of the image bearing member by a roller-shaped protective agent supplying member.

The protective layer method for forming is favorably carried out by the protective layer forming unit in the image forming apparatus of the present invention, and thus a detailed explanation thereof is omitted.

The protective layer formation step is not particularly restricted as long as it forms the protective layer on the surface of the image bearing membe, and it may be appropriately selected according to purpose. Nonetheless, it is preferably carried out by coating or adhering the image bearing member protective agent on a surface of the image bearing member after the visible image is transferred to the recording medium, preferably by the transfer unit in the image forming apparatus the present invention.

A method for the coating or adhering is not particularly restricted and may be appropriately selected according to purpose. Nonetheless, it is preferably coated or adhered by the pressure-imparting member and the protective layer forming member.

Figure 6:
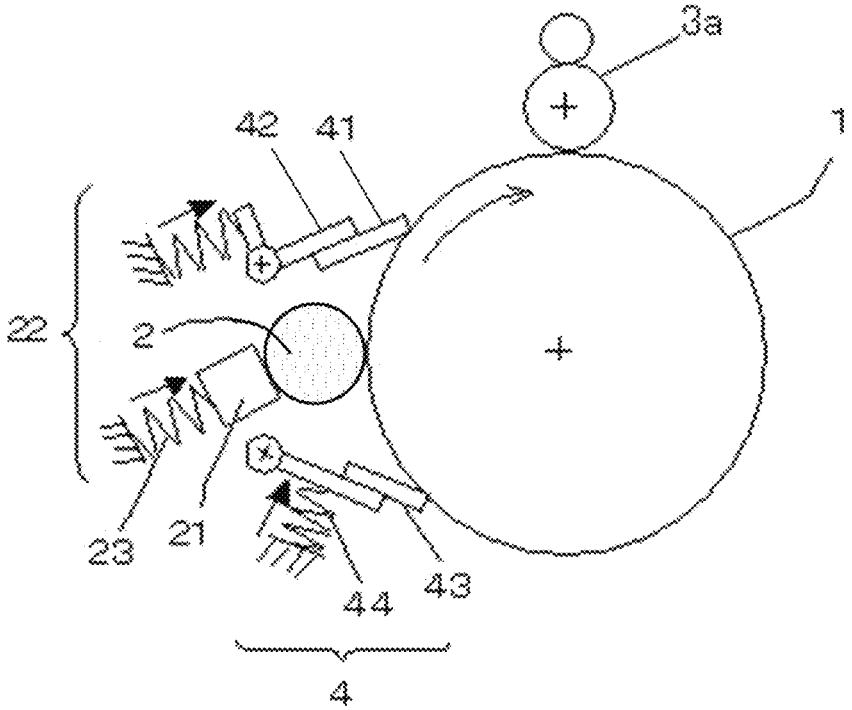
FIG. 6 is a schematic cross-sectional diagram illustrating one example of a protective layer forming apparatus.

The protective layer forming apparatus and the method for forming a protective layer is explained using a diagram. FIG. 6 is a schematic cross-sectional diagram illustrating one example of the protective layer forming apparatus.

A protective layer forming unit (22) provided opposite to the image bearing member (1) as an image bearing member is formed mainly of a protective agent block (21), a protective agent supplying member (2) including a foamed elastic layer, a pressure-imparting member (23), a protective layer forming member (41) fixed on a substrate (42) and so on.

The protective agent block (21) contacts the roller-shaped protective agent supplying member (2) by a pressing force of the pressure-imparting member (23). The protective agent supplying member (2) rubs the image bearing member (1) by rotating preferably with a linear velocity difference with the image bearing member (1), and thereby, the protective agent held on the surface of the protective agent supplying member (2) is supplied on the surface of the image bearing member (1).

There are cases where the protective agent supplied on the surface of the image bearing member (1) does not form a sufficient protective layer when it is being supplied depending on the selection of the materials. Thus, in order to form a more uniform protective layer, for example, it is thin-layered by the protective agent supplying member (41) having a blade-shaped member to form the protective layer.

For example, the image bearing member (1) on which the protective layer is formed, is contacted or closely approached by a charging roller (charging unit) (3*a*) on which a DC voltage or a voltage that an AC voltage is superimposed on the DC voltage is applied by a high-voltage power source not shown, and thereby the image bearing member is charged by discharge in microvoids. On this occasion, a part of the protective layer is decomposed or oxidized due to electrical stresses, and also, discharge products into the air adhere on the surface of the protective layer.

Here, the degraded protective agent for the image bearing member is removed by a cleaning mechanism of an ordinary cleaning unit along with components such as toner remaining on the image bearing member. Such a cleaning unit may also serve as the protective layer forming member (41). However, there are cases where appropriate rubbing conditions of the members are different between a function for removing residuals on the surface of the image bearing member and a function for forming a protective layer, and thus the functions are preferably separated in order to form the protective layer more reliably. As such an embodiment, as illustrated in FIG. 6, it is preferable to provide the cleaning unit (4) including a cleaning member (43), a cleaning pressing member (44) and so on in an upstream side of the protective agent supplying member (2) in a direction of rotation of the image bearing member (1) so that residuals such as toner on the surface of the image bearing member (1) is removed beforehand by the cleaning member (43) to prevent the residuals from being mixed in the protective layer.

EXAMPLES

Hereinafter, the present invention is further described in detail with reference to Examples, which however shall not be construed as limiting the scope of the present invention.

Production Example 1-1

Production of Image Bearing Member Protective Agent 1

A mixture of 90 parts by mass of zinc stearate (GF-200, manufactured by NOF Corporation) and 10 parts by mass of boron nitride (NX5, manufactured by Momentive Performance Materials Inc.) was placed in a predetermined mold and was leveled. It was then subjected to a compression molding with a pressure of 130 kN and a compression time of 10 seconds. Thereby, Image Bearing Member Protective Agent 1 of a rectangular column having a length in a height direction of 10 mm, a length in a lateral direction of 21 mm, and a length in a longitudinal direction of 300 mm was obtained.

Production Example 1-2

Production of Image Bearing Member Protective Agent 2

A mixture of 90 parts by mass of zinc stearate (GF-200, manufactured by NOF Corporation) and 10 parts by mass of mica (SAMICA, manufactured by Miyoshi Kasei Industry Co., Ltd.) was placed in a predetermined mold and was leveled. It was then subjected to a compression molding with a pressure of 130 kN and a compression time of 10 seconds. Thereby, Image Bearing Member Protective Agent 2 of a rectangular column having a length in a height direction of 10 mm, a length in a lateral direction of 21 mm, and a length in a longitudinal direction of 300 mm was obtained.

Production Example 1-3

Production of Image Bearing Member Protective Agent 3

A mixture of 90 parts by mass of zinc stearate (GF-200, manufactured by NOF Corporation) and 10 parts by mass of talc (PFITALC, manufactured by Miyoshi Kasei Industry Co., Ltd.) was placed in a predetermined mold and was leveled. It was then subjected to a compression molding with a pressure of 130 kN and a compression time of 10 seconds. Thereby, Image Bearing Member Protective Agent 3 of a rectangular column having a length in a height direction of 10 mm, a length in a lateral direction of 21 mm, and a length in a longitudinal direction of 300 mm was obtained.

Image Bearing Member Protective Agents 1 to 3 produced in Production Examples 1-1 to 1-3 are summarized below in Table 1.

TABLE 1

| | | Molding method | Metal salt of fatty acid | Inorganic lubricant |
|---|---|---|---|---|
| Production Example 1-1 | Image Bearing Member Protective Agent 1 | Compression molding | Zinc stearate | Boron nitride |
| Production Example 1-2 | Image Bearing Member Protective Agent 2 | Compression molding | Zinc stearate | Mica |
| Production Example 1-3 | Image Bearing Member Protective Agent 3 | Compression molding | Zinc stearate | Talc |

Production Example 2-1

Production of Protective Agent Supplying Member 1

Foamed polyurethane (product name: QM60, manufactured by Bridgestone Diversified Chemical Products Co., Ltd.) was cut out in a rectangular column of a predetermined size, a hole was opened to insert a core material (diameter: 6 mm; length: 365 mm; made of stainless steel), and the core material was inserted and fixed in the hole. Thereafter, a roller having the core material as an axis was cut out, and a foam layer of foamed polyurethane was formed on an outer periphery of the core material. Thereby, Protective Agent Supplying Member 1 was produced.

The foam layer of Protective Agent Supplying Member 1 was observed or measured by the following method. Cells were continuous cells, having an average thickness of 3 mm, and a number of cells m was 60 cells/inch. Also, a diameter of Protective Agent Supplying Member 1 was 12 mm.

—Observation of Structure of Cells in Foam Layer—

The foam layer of the obtained protective agent supplying member was observed under a microscope (manufactured by Keyence Corporation, DIGITAL MICROSCOPE VHX-100).

—Measurement of Thickness of Foam Layer—

The thickness of the obtained protective agent supplying member was measured using a measurement apparatus (RSV-1560PIIC, manufactured by Tokyo Opto-Electronics Co., Ltd.) and a laser micro-gauge (a non-contact dimension measurement device, MG1505PII, manufactured by Tokyo Opto-Electronics Co., Ltd.). That is, after an outer diameter (a) of the protective agent supplying member was measured, an outer diameter (b) of the core material (shaft) was measured. Then, the thickness of the foam layer was determined from the formula below. Using a similar method, a thickness of the foam layer was measured at 3 locations in a longitudinal direction, and an average value thereof was calculated as an average thickness of the foam layer.

Thickness of foam layer [mm]=[(a) [mm]−(b) [mm]]/2

—Measurement of Number of Cells m Per 1 Inch of Foam Layer—

As illustrated in FIG. 2A, on a surface of the foam layer (10), 3 points were arbitrarily selected as measurement points at end portions and central portion in an axial direction of the protective agent supplying member (2). Next, at each of the measurement points, 2 more points were further selected in a circumferential direction of the protective agent supplying member, and 9 measurement points in total were determined. Next, using a microscope (DIGITAL MICROSCOPE VHX-100, manufactured by Keyence Corporation), a photo screen at each measurement point was observed.

Thereafter, a line (X) having a length corresponding to 1 inch (25.4 mm) in a real scale at a central portion of the photo screen was drawn, a number of cells existing on the line (X) (11) was counted, and an average value of the numbers of cells at 9 measurement points was obtained.

Here, the cells existing on the line (X) include not only the cells penetrated by the line (X) but also all the cells which contact the line (X) even though only a part of an outer periphery of the cells (11) is in contact with the line (X), and all of them were counted.

Production Examples 2-2 to 2-8

Production of Protective Agent Supplying Members 2 to 8

Protective Agent Supplying Members 2 to 8 were manufactured in the same manner as Production Example 2-1 except that the foamed polyurethane (product name: QM60, manufactured by Bridgestone Diversified Chemical Products Co., Ltd.) was changed to foamed polyurethanes shown in Table 2 below in producing the protective agent supplying member of Production Example 2-1.

Also, for the respective foam layers of the obtained Protective Agent Supplying Members 2 to 8, a structure of cells, an average thickness and a number of cells were observed in the same manner as Production Example 2-1. Results are shown in Table 2 as well.

TABLE 2

| | Protective agent supplying member | | | Foam layer | | | | |
|---|---|---|---|---|---|---|---|---|
| | Type of protective agent supplying member | Diameter (mm) | Radius (mm) | Product name | Manufacturer | Structure of cells | Average thickness (mm) | Number of cells m (cells/inch) |
| Production Example 2-1 | 1 | 12 | 6 | QM60 | BDCP* | Continuous cells | 3 | 60 |
| Production Example 2-2 | 2 | 12 | 6 | QZK70 | BDCP* | Continuous cells | 3 | 75 |
| Production Example 2-3 | 3 | 12 | 6 | SPG | BDCP* | Continuous cells | 3 | 90 |
| Production Example 2-4 | 4 | 12 | 6 | RMM | INOAC** | Continuous cells | 3 | 50 |
| Production Example 2-5 | 5 | 12 | 6 | QM61 | BDCP* | Continuous cells | 3 | 60 |
| Production Example 2-6 | 6 | 12 | 6 | QM62 | BDCP* | Continuous cells | 3 | 60 |
| Production Example 2-7 | 7 | 12 | 6 | HPY-70 | BDCP* | Continuous cells | 3 | 68 |
| Production Example 2-8 | 8 | 12 | 6 | QZK70 | BDCP* | Continuous cells | 3 | 76 |

*BDCP denotes Bridgestone Diversified Chemical Products.

**INOAC denotes INOAC Corporation.

Production Example 3-1

Production of Image Bearing Member 1

—Formation of Undercoat Layer—

On an aluminum substrate (outer diameter: 40 mm), an undercoat layer coating solution having the following composition was dip-coated followed by heating and drying, and an undercoat layer having a thickness of 3.5 μm was formed. DN410H (manufactured by Yamato Scientific Co., Ltd.) was used for the heating and drying.

| [Undercoat layer coating solution] | |
|---|---|
| Alkyd resin (BECKOSOL 1307-60-EL, manufactured by DIC Corporation) | 6 parts by mass |
| Melamine resin (SUPER BECKAMINE G-821-60, manufactured by DIC Corporation) | 4 parts by mass |
| Titanium oxide | 40 parts by mass |
| Methyl ethyl ketone | 50 parts by mass |

—Formation of Charge Generation Layer—

Next, on the undercoat layer, a charge generation layer coating solution having the following composition was dip-coated followed by heating and drying, and a charge generation layer having a thickness of 0.2 μm was formed. For the heating and drying, DN410H (manufactured by Yamato Scientific Co., Ltd.) was used.

| [Charge generation layer coating solution] | |
|---|---|
| Bisazo pigment represented by Structural Formula (I) below | 2.5 parts by mass |
| Polyvinyl butyral (XYHL, manufactured by UCC) | 0.5 parts by mass |
| Cyclohexanone | 200 parts by mass |
| Methyl ethyl ketone | 80 parts by mass |

Structural Formula (I)

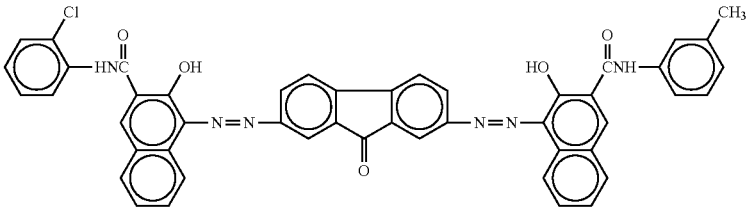

—Formation of Charge Transport Layer—

Next, on the charge generation layer, a charge transport layer coating solution having the following composition was dip-coated followed by heating and drying, and a charge transport layer having a thickness of 18 μm was formed. For the heating and drying, DN410H (manufactured by Yamato Scientific Co., Ltd.) was used.

| [Charge transport layer coating solution] | |
|---|---|
| Bisphenol Z polycarbonate (PANLITE TS-2050, manufactured by Teijin Chemicals Ltd.) | 10 parts by mass |

-continued

| [Charge transport layer coating solution] | |
|---|---|
| Low-molecular charge transport material represented by Structural Formula (II) below | 7 parts by mass |
| Tetrahydrofuran | 100 parts by mass |
| 1-% by mass tetrahydrofuran solution of silicon oil (KF50-100CS, manufactured by Shin-Etsu Chemical Co., Ltd.) | 1 part by mass |

Structural Formula (II)

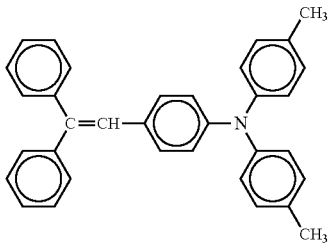

—Formation of Photoconductive Layer—

Next, on the charge transport layer, a photoconductive layer coating solution having the following composition was spray-coated and subjected to light irradiation under conditions of a metal halide lamp of 160 W/cm; an irradiation distance of 120 mm; an irradiation intensity of 200 mW/cm$^2$; and an irradiation time of 20 seconds, which was further dried using DN410H (manufactured by Yamato Scientific Co., Ltd.) at 130° C. for 20 minutes, and thereby a photoconductive layer having a thickness of 4 μm was formed.

| [Photoconductive layer coating solution] | |
|---|---|
| Trifunctional or more radical polymerizable monomer having no charge transporting structure (Trimethylolpropane triacrylate: molecular weight: 296, number of functional groups: tri-functional; molecular weight/number of functional groups = 99; KAYARAD TMPTA, manufactured by Nippon Kayaku Co., Ltd.) | 10 parts by mass |
| Monofunctional radical polymerizable compound having a charge transporting structure represented by structural formula (III) below | 10 parts by mass |
| Photopolymerization initiator (1-Hydroxy-cyclohexyl-phenyl-ketone; IRGACURE 184, manufactured by Ciba Specialty Chemicals Inc.) | 1 part by mass |
| Tetrahydrofuran | 100 parts by mass |

Structural Formula (III)

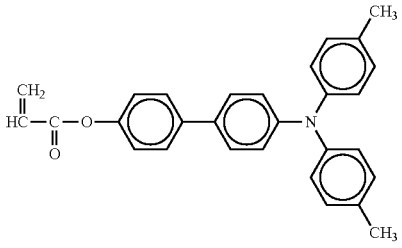

Production Example 3-2

Production of Image Bearing Member 2

Image Bearing Member 2 was manufactured in the same manner as Production Example 3-1 except that the aluminum substrate (outer diameter: 40 mm) in Production Example 3-1 was changed to an aluminum substrate (outer diameter: 30 mm).

Example 1

Using an apparatus that a printer (IMAGIO MP C5000, manufactured by Ricoh Company, Ltd.) was remodeled, an image bearing member protective agent was applied on an image bearing member.

That is, in an image-forming section of the printer (IMAGIO MP C5000, manufactured by Ricoh Company, Ltd.), an image bearing member used in the printer was changed to Image Bearing Member 1 having an outer diameter of 40 mm manufactured in Production Example 3-1; an image bearing member protective agent used in the printer was changed to Image Bearing Member Protective Agent 1 manufactured in Production Example 1-1; and a brush roller used in the printer was changed to Protective Agent Supplying Member 1 manufactured in Production Example 2-1. Also, a biting amount of the image bearing member against Protective Agent Supplying Member 1 was adjusted to be 0.80 mm. The protective layer forming apparatus in the apparatus remodeled as above had a structure illustrated in FIG. 6.

At this time, a nip distance (L) between Protective Agent Supplying Member 1 and a surface of the image bearing member measured by the following method was 5.23 mm, and a number of cells n existing at a contact portion of the surface of the image bearing member and the protective agent supplying member (on the nip distance (L)) was 12.81.

Here, a technique described in JP-A No. 2007-293240 was employed in the printer (IMAGIO MP C5000, manufactured by Ricoh Company, Ltd.) as an image bearing member protective agent pressurizing mechanism member (a pressure-imparting member) which pressed the image bearing member protective agent to contact the protective agent supplying member, and the printer was able to press the image bearing member protective agent at a constant pressure and a uniform pressure in a longitudinal direction over time. Here, an application force of IMAGIO MP C5000 was 6N.

—Measurement of Nip Distance L and Biting Amount d—

The nip distance L was measured by marking a nip portion (e1) and a nip portion (e2) in Image Bearing Member 1 or 2 on Image Bearing Member 1 or 2 (see FIG. 3). Next, from Equation 1 below, an angle (θ) formed by a line (b) and a line (c) was determined. Next, from Equation 2 below, a biting amount (d) was obtained.

$$L=2\times b\times\pi\times(2\times\theta/360) \quad \text{(Equation 1)}$$

$$a^2=b^2+(a+b-d)^2-2b(a+b-d)\times\cos\theta \quad \text{(Equation 2)}$$

In Equation 1 and Equation 2, "a" represents a radius of Protective Agent Supplying Members 1 to 6; "b" represents a radius of Image Bearing Member 1 or 2; and "L" represents a distance between the nip portion (e1) and the nip portion (e2) on an outer periphery of the image bearing member.

—Calculation of Number of Cells n—

A number of cells n existing at the contact portion between the surface of the image bearing member and the protective agent supplying member (on the nip distance (L)) was calculated using Equation 3 below from the nip distance (L) determined by Equation 4 and a number of cells per 1 inch of the foam layer (m) of Protective Agent Supplying Members 1 to 6. Similarly, the number of cells n was measured at three points selected arbitrarily in an axial direction of the protective agent supplying member, and an average value thereof was calculated as the number of cells n at the nip.

$$\text{Number of cells } n(\text{cells})=m(\text{cells/inch})/25.4\times L(\text{mm}) \quad \text{(Equation 3)}$$

Here, in Equation 3, 1 inch=25.4 mm.

<Evaluation>

—Minimum Consumption Rate of Image Bearing Member Protective Agent with No Occurrence of Filming of Image Bearing Member—

First, using the apparatus that the printer (IMAGIO MP C5000, manufactured by Ricoh Company, Ltd.) was remodeled, 10,000 sheets of a document (A4) were continuously printed out with an image area ratio of 5%, and the parts in the remodeled apparatus were subjected to change over time before a continuous printing test of 1,000 sheets below.

Next, 1,000 sheets of a document (A4) were continuously printed out with an image area ratio of 100%. This test of continuously printing 1,000 sheets was carried out by gradually decreasing a spring load of the pressure-imparting member. Consumption (g) of the image bearing member protective agent was calculated by comparing the amounts of the image bearing member protective agent (g) before and after the test. This consumption (g) was divided by a distance traveled by the image bearing member (km), and a protective agent consumption rate (g/km) was calculated.

Occurrence of filming at the surface of the image bearing member as the protective agent consumption rate (g/km) was decreased was visually observed. Thereafter, a minimum protective agent consumption rate (g/km) at which no filming occurred was obtained and evaluated based on the following criteria. Results are shown in Table 4.

[Evaluation Criteria]

A: Protective agent consumption rate was less than 0.20 g/km

B: Protective agent consumption rate was 0.20 g/km or greater and less than 0.25 g/km C: Protective agent consumption rate was 0.25 g/km or greater.

Here, in the evaluation criteria above, A and B were considered as acceptable.

Examples 2 to 16

Comparative Examples 1 to 7

In Examples 2 to 16 and Comparative Examples 1 to 7, an image bearing member protective agent was coated on an image bearing member in the same manner as Example 1 except that the number of cells n, the outer diameter of the image bearing member, the biting amount of the image bearing member against the protective agent supplying member, the linear velocity of the protective agent supplying member and so on in Example 1 were changed to the conditions shown in Table 3-1 to Table 3-4 below, and a minimum consumption rate of each image bearing member protective agent at which no filming of the image bearing member occurred was evaluated in the same manner as Example 1. Results are shown in Table 4.

TABLE 3-1

| | Image bearing member protective agent | | | |
|---|---|---|---|---|
| | | Protective agent composition | | |
| | Type | Metal salt of fatty acid | Inorganic lubricant | Molding method |
| Example 1 | 1 | zinc stearate | boron nitride | compression |
| Example 2 | 1 | zinc stearate | boron nitride | compression |
| Example 3 | 1 | zinc stearate | boron nitride | compression |
| Example 4 | 1 | zinc stearate | boron nitride | compression |
| Example 5 | 1 | zinc stearate | boron nitride | compression |

TABLE 3-1-continued

| | Image bearing member protective agent | | | |
|---|---|---|---|---|
| | | Protective agent composition | | |
| | Type | Metal salt of fatty acid | Inorganic lubricant | Molding method |
| Example 6 | 2 | zinc stearate | mica | compression |
| Example 7 | 3 | zinc stearate | talc | compression |
| Comp. Ex. 1 | 1 | zinc stearate | boron nitride | compression |
| Comp. Ex. 2 | 1 | zinc stearate | boron nitride | compression |
| Comp. Ex. 3 | 1 | zinc stearate | boron nitride | compression |
| Comp. Ex. 4 | 1 | zinc stearate | boron nitride | compression |
| Example 8 | 1 | zinc stearate | boron nitride | compression |
| Example 9 | 1 | zinc stearate | boron nitride | compression |
| Example 10 | 2 | zinc stearate | mica | compression |
| Example 11 | 1 | zinc stearate | boron nitride | compression |
| Example 12 | 1 | zinc stearate | boron nitride | compression |
| Example 13 | 1 | zinc stearate | boron nitride | compression |
| Example 14 | 1 | zinc stearate | boron nitride | compression |
| Example 15 | 1 | zinc stearate | boron nitride | compression |
| Example 16 | 3 | zinc stearate | talc | compression |
| Comp. Ex. 5 | 1 | zinc stearate | boron nitride | compression |
| Comp. Ex. 6 | 1 | zinc stearate | boron nitride | compression |
| Comp. Ex. 7 | 1 | zinc stearate | boron nitride | compression |

TABLE 3-2

| | Protective agent supplying member | | |
|---|---|---|---|
| | | Foam layer | |
| | Type | Structure of cells | Number of cells m (cells/inch) |
| Example 1 | 1 | continuous cells | 60 |
| Example 2 | 2 | continuous cells | 75 |
| Example 3 | 3 | continuous cells | 90 |
| Example 4 | 4 | continuous cells | 50 |
| Example 5 | 3 | continuous cells | 90 |
| Example 6 | 1 | continuous cells | 60 |
| Example 7 | 5 | continuous cells | 60 |
| Comp. Ex. 1 | 6 | continuous cells | 60 |
| Comp. Ex. 2 | 4 | continuous cells | 50 |
| Comp. Ex. 3 | 3 | continuous cells | 90 |
| Comp. Ex. 4 | 2 | continuous cells | 75 |
| Example 8 | 4 | continuous cells | 50 |
| Example 9 | 1 | continuous cells | 60 |
| Example 10 | 1 | continuous cells | 60 |
| Example 11 | 1 | continuous cells | 60 |
| Example 12 | 7 | continuous cells | 68 |
| Example 13 | 7 | continuous cells | 68 |
| Example 14 | 8 | continuous cells | 76 |
| Example 15 | 8 | continuous cells | 76 |
| Example 16 | 1 | continuous cells | 60 |
| Comp. Ex. 5 | 1 | continuous cells | 60 |
| Comp. Ex. 6 | 3 | continuous cells | 90 |
| Comp. Ex. 7 | 1 | continuous cells | 60 |

TABLE 3-3

| | Image forming apparatus | | | |
|---|---|---|---|---|
| | Photoconductor | | | |
| | Type | Outer diameter (mm) | Biting amount (mm) | Nip distance L (mm) |
| Example 1 | 1 | 40 | 0.8 | 5.23 |
| Example 2 | 2 | 30 | 0.8 | 5.06 |
| Example 3 | 1 | 40 | 0.8 | 5.06 |
| Example 4 | 1 | 40 | 0.6 | 4.49 |
| Example 5 | 1 | 40 | 1.1 | 6.22 |
| Example 6 | 1 | 40 | 0.8 | 5.23 |

TABLE 3-3-continued

| | Image forming apparatus | | | |
|---|---|---|---|---|
| | Photoconductor | | | |
| | Type | Outer diameter (mm) | Biting amount (mm) | Nip distance L (mm) |
| Example 7 | 1 | 40 | 0.8 | 5.23 |
| Comp. Ex. 1 | 1 | 40 | 0.4 | 3.40 |
| Comp. Ex. 2 | 2 | 30 | 0.6 | 4.34 |
| Comp. Ex. 3 | 1 | 40 | 1.2 | 6.52 |
| Comp. Ex. 4 | 1 | 40 | 1.6 | 7.66 |
| Example 8 | 1 | 40 | 0.8 | 5.33 |
| Example 9 | 1 | 40 | 0.8 | 5.33 |
| Example 10 | 1 | 40 | 0.8 | 5.33 |
| Example 11 | 1 | 40 | 0.8 | 5.33 |
| Example 12 | 1 | 40 | 0.8 | 5.33 |
| Example 13 | 1 | 40 | 0.8 | 5.33 |
| Example 14 | 1 | 40 | 0.8 | 5.33 |
| Example 15 | 1 | 40 | 0.8 | 5.33 |
| Example 16 | 1 | 40 | 0.8 | 5.33 |
| Comp. Ex. 5 | 1 | 40 | 0.8 | 5.33 |
| Comp. Ex. 6 | 1 | 40 | 0.8 | 5.33 |
| Comp. Ex. 7 | 1 | 40 | 0.8 | 5.33 |

TABLE 3-4

| | Image forming apparatus | | | | |
|---|---|---|---|---|---|
| | Number of cells n (cells) | Linear velocity of protective agent supplying member (mm/s) | Linear velocity of image bearing member (mm/s) | Linear velocity difference (mm/s) | Cell speed (cells/mm$^2$/s) |
| Example 1 | 12.81 | 142 | 230 | 372 | 2075.76 |
| Example 2 | 15.50 | 142 | 230 | 372 | 3243.38 |
| Example 3 | 18.59 | 142 | 230 | 372 | 4670.47 |
| Example 4 | 9.16 | 138 | 230 | 368 | 1426.00 |
| Example 5 | 22.84 | 149 | 230 | 379 | 4758.35 |
| Example 6 | 12.81 | 142 | 230 | 372 | 2075.76 |
| Example 7 | 12.81 | 142 | 230 | 372 | 2075.76 |
| Comp. Ex. 1 | 8.32 | 133 | 230 | 363 | 2025.54 |
| Comp. Ex. 2 | 8.86 | 138 | 230 | 368 | 1426.00 |
| Comp. Ex. 3 | 23.96 | 152 | 230 | 382 | 4796.02 |
| Comp. Ex. 4 | 23.46 | 161 | 230 | 391 | 3409.04 |
| Example 8 | 10.67 | 142 | 230 | 372 | 1441.50 |
| Example 9 | 12.81 | 142 | 230 | 372 | 2075.76 |
| Example 10 | 12.81 | 142 | 230 | 372 | 2075.76 |
| Example 11 | 12.81 | 228 | 230 | 458 | 2555.65 |
| Example 12 | 14.51 | 142 | 230 | 372 | 2666.20 |
| Example 13 | 14.51 | 228 | 230 | 458 | 3282.58 |
| Example 14 | 16.23 | 142 | 230 | 372 | 3330.45 |
| Example 15 | 16.23 | 228 | 230 | 458 | 4100.39 |
| Example 16 | 12.81 | 142 | 230 | 372 | 2075.76 |
| Comp. Ex. 5 | 12.81 | −80 | 230 | 150 | 837.00 |
| Comp. Ex. 6 | 19.21 | 142 | 230 | 372 | 4670.47 |
| Comp. Ex. 7 | 12.81 | −230 | 230 | 0 | 0 |

In Table 3-4, a negative value of the linear velocity of the protective agent supplying member indicates that it rotates in a trailing direction against the image bearing member.

TABLE 4

| | protective agent consumption rate | |
|---|---|---|
| | Minimum consumption rate (g/km) | Evaluation |
| Example 1 | 0.15 | A |
| Example 2 | 0.13 | A |
| Example 3 | 0.18 | A |

TABLE 4-continued

| | protective agent consumption rate | |
|---|---|---|
| | Minimum consumption rate (g/km) | Evaluation |
| Example 4 | 0.21 | B |
| Example 5 | 0.23 | B |
| Example 6 | 0.14 | A |
| Example 7 | 0.16 | A |
| Comp. Ex. 1 | 0.28 | C |
| Comp. Ex. 2 | 0.26 | C |
| Comp. Ex. 3 | 0.32 | C |
| Comp. Ex. 4 | 0.36 | C |
| Example 8 | 0.14 | A |
| Example 9 | 0.15 | A |
| Example 10 | 0.14 | A |
| Example 11 | 0.11 | A |
| Example 12 | 0.15 | A |
| Example 13 | 0.13 | A |
| Example 14 | 0.14 | A |
| Example 15 | 0.13 | A |
| Example 16 | 0.16 | A |
| Comp. Ex. 5 | 0.25 | C |
| Comp. Ex. 6 | 0.32 | C |
| Comp. Ex. 7 | 0.3 or greater | C |

It was found from the results of Examples 1 to 16 that the image forming apparatus of the present invention was able to prevent the toner or the protective agent from slipping through the cleaning unit and prevent the image bearing member or the charging unit from being contaminated.

On the other hand, in Comparative Examples 1, 2 and 5, the protective agent supplying member could not sufficiently contact the image bearing member, and the protective agent scraped from the protective agent block cannot be passed to the image bearing member. Thus, the minimum consumption rate of the image bearing member protective agent with no occurrences of filming of the image bearing member was high.

In Comparative Examples 3, 4 and 6, a high number of contacts between the image bearing member and the protective agent supplying member could be maintained, and more amount of the protective agent could be passed to the image bearing member. On the other hand, the number of contacts was in excess, and the protective agent applied once on the image bearing member was scraped off again.

In Comparative Example 7, the protective agent could not be passed since there was no linear velocity difference between the image bearing member and the protective agent supplying member.

Aspects of the present invention are the following.

<1> An image forming apparatus, including at least:

an image bearing member;

a protective layer forming unit which includes at least a protective agent supplying member which rotatably contacts a surface of the image bearing member and an image bearing member protective agent; and a rotational speed controlling unit which controls a rotational speed of the protective agent supplying member, wherein the image bearing member protective agent includes at least a metal salt of a fatty acid and an inorganic lubricant, wherein the protective agent supplying member includes: a core material; and a foam layer which is formed on an outer periphery of the core material and includes a plurality of cells, wherein a number of cells n is greater than 9 and less than 23, where n is the number of cells existing at a contact portion of a surface of the image bearing member and the protective agent supplying member on a cross-sectional surface in a circumferential direction of the image bearing member and the protective agent supplying member, and wherein the rotational speed controlling unit controls a traveling speed V of the cells with respect to the surface of the image bearing member at the contact portion within a range of greater than 837 cells/$mm^2$/s and less than 4,670 cells/$mm^2$/s.

<2> The image forming apparatus according to <1>, wherein the protective layer forming unit further includes a protective layer forming member which presses the image bearing member protective agent supplied on the surface of the image bearing member by the protective agent supplying member into a film.

<3> The image forming apparatus according to any one of <1> to <2>, further including:

a transfer unit which transfers a visible image to a recording medium; and a cleaning unit which is provided at a downstream side of the transfer unit and an upstream side of the protective layer forming unit and removes a residual toner on the surface of the image bearing member from the surface of the image bearing member.

<4> The image forming apparatus according to any one of <1> to <3>, wherein the inorganic lubricant includes at least any one selected from talc, mica and boron nitride, and the metal salt of a fatty acid includes at least zinc stearate.

<5> The image forming apparatus according to any one of <1> to <4>, wherein the image bearing member protective agent is block-shaped that a particulate or granular material thereof is subjected to compression molding in a mold.

<6> A protective agent supplying member used in the image forming apparatus according to any one of <1> to <5>, wherein the protective agent supplying member includes: a core material; and a foam layer which is formed on an outer periphery of the core material and includes a plurality of cells, wherein a number of cells n is greater than 9 and less than 23, where n is the number of cells existing at a contact portion of a surface of the image bearing member and the protective agent supplying member on a cross-sectional surface in a circumferential direction of the image bearing member and the protective agent supplying member.

<7> A protective layer forming apparatus used in the image forming apparatus according to any one of <1> to <5>, wherein the protective layer forming apparatus includes at least:

a protective layer forming unit which includes at least a protective agent supplying member which rotatably contacts the surface of the image bearing member in the image forming apparatus and an image bearing member protective agent; and a rotational speed controlling unit which controls a rotational speed of the protective agent supplying member, wherein the image bearing member protective agent includes at least a metal salt of a fatty acid and an inorganic lubricant, wherein the protective agent supplying member includes: a core material; and a foam layer which is formed on an outer periphery of the core material and includes a plurality of cells, wherein a number of cells n is greater than 9 and less than 23, where n is the number of cells existing at a contact portion of a surface of the image bearing member and the protective agent supplying member on a cross-sectional surface in a circumferential direction of the image bearing member and the protective agent supplying member, and wherein the rotational speed controlling unit controls a traveling speed V of the cells with respect to the surface of the image bearing member at the contact portion within a range of greater than 837 cells/$mm^2$/s and less than 4,670 cells/$mm^2$/s.

<8> A method for forming a protective layer, including:

forming a protective layer;

wherein the protective layer is formed by:

a protective layer forming unit which includes at least: a protective agent supplying member which rotatably contacts a surface of an image bearing member; and an image bearing member protective agent; and a rotational speed controlling unit which controls a rotational speed of the protective agent supplying member, wherein the protective layer protects the surface of the image bearing member, wherein the image bearing member protective agent includes at least a metal salt of a fatty acid and an inorganic lubricant, wherein the protective agent supplying member includes: a core material; and a foam layer which is formed on an outer periphery of the core material and includes a plurality of cells, wherein a number of cells n is greater than 9 and less than 23, where n is the number of cells existing at a contact portion of a surface of the image bearing member and the protective agent supplying member on a cross-sectional surface in a circumferential direction of the image bearing member and the protective agent supplying member, and wherein the rotational speed controlling unit controls a traveling speed V of the cells with respect to the surface of the image bearing member at the contact portion within a range of greater than 837 cells/$mm^2$/s and less than 4,670 cells/$mm^2$/s.

This application claims priority to Japanese application No. 2012-035239, filed on Feb. 21, 2012 and incorporated herein by reference.

What is claimed is:

1. An image forming apparatus, comprising:

an image bearing member;

a protective layer forming unit which comprises a protective agent supplying member which rotatably contacts a surface of the image bearing member and an image bearing member protective agent; and a rotational speed controlling unit which controls a rotational speed of the protective agent supplying member, wherein the image bearing member protective agent comprises a metal salt of a fatty acid and an inorganic lubricant, wherein the protective agent supplying member comprises: a core material; and a foam layer which is formed on an outer periphery of the core material and includes a plurality of cells, wherein a number of cells n is greater than 9 and less than 23, where n is the number of cells existing at a contact portion of a surface of the image bearing member and the protective agent supplying member on a cross-sectional surface in a circumferential direction of the image bearing member and the protective agent supplying member, and wherein the rotational speed controlling unit controls a traveling speed V of the cells with respect to the surface of the image bearing member at the contact portion within a range of greater than 837 cells/$mm^2$/s and less than 4,670 cells/$mm^2$/s.

2. The image forming apparatus according to claim 1, wherein the protective layer forming unit further comprises a protective layer forming member which presses the image bearing member protective agent supplied on the surface of the image bearing member by the protective agent supplying member into a film.

3. The image forming apparatus according to claim 1, further comprising:

a transfer unit which transfers a visible image to a recording medium; and a cleaning unit which is provided at a downstream side of the transfer unit and an upstream side of the protective layer forming unit and removes a residual toner on the surface of the image bearing member from the surface of the image bearing member.

4. The image forming apparatus according to claim 1, wherein the inorganic lubricant comprises any one selected from talc, mica and boron nitride.

5. The image forming apparatus according to claim 1, wherein the metal salt of a fatty acid comprises zinc stearate.

6. The image forming apparatus according to claim 1, wherein the image bearing member protective agent is block-shaped that and is formed by subjecting a particulate or granular material to compression molding in a mold.

* * * * *